US011453133B2

(12) United States Patent
Mayberry et al.

(10) Patent No.: US 11,453,133 B2
(45) Date of Patent: Sep. 27, 2022

(54) FOLDING KNIFE

(71) Applicant: Magpul Industries Corp., Austin, TX (US)

(72) Inventors: Michael T. Mayberry, Denver, CO (US); Danny R. Smith, Jr., Westminster, CO (US); Thomas Ward, Tualatin, OR (US); Timothy Eric Roberts, Broomfield, CO (US); Timothy James Galyean, Yamhill, OR (US)

(73) Assignee: Magpul Industries Corp., Austin, TX (US)

( * ) Notice: Subject to any disclaimer, the term of this patent is extended or adjusted under 35 U.S.C. 154(b) by 0 days.

(21) Appl. No.: 16/268,608

(22) Filed: Feb. 6, 2019

(65) Prior Publication Data

US 2020/0189127 A1 Jun. 18, 2020

Related U.S. Application Data

(60) Provisional application No. 62/781,518, filed on Dec. 18, 2018, provisional application No. 62/785,730, filed on Dec. 28, 2018.

(51) Int. Cl.
*B26B 1/04* (2006.01)

(52) U.S. Cl.
CPC ..... *B26B 1/044* (2013.01); *B26B 1/046* (2013.01)

(58) Field of Classification Search
CPC ..... B26B 1/046; B26B 1/04; B26B 1/044; B26B 1/06; B26B 1/042
See application file for complete search history.

(56) References Cited

U.S. PATENT DOCUMENTS 2,725,438 A * 11/1955 Bentley ..... H01H 23/168 200/557
2,821,588 A * 1/1958 Fisher ..... H01H 13/28 200/443

(Continued)

FOREIGN PATENT DOCUMENTS

DE 202015103807 U1 8/2015
WO 2014130333 A1 8/2014

OTHER PUBLICATIONS

Connelley, Larry, "Benchmade Axis Lock—Knife Lock Mechanism Explained", "Retrieved from https://www.knifeart.com/benchmade-axis-lock.html", 2016, p. 2, Published in: US.

(Continued)

*Primary Examiner* — Evan H MacFarlane
*Assistant Examiner* — Fernando A Ayala
(74) *Attorney, Agent, or Firm* — Neugeboren O'Dowd PC

(57) ABSTRACT

Systems, methods, and apparatus are described for a locking folding knife having a handle lock and a safety switch arranged around and rotatable around a pivot axis of the knife. In an engaged position the switch overlaps at least a portion of the handle lock and prevents it from moving into an unlocked position. A spring, such as a wire form spring, can be arranged within a pocket of the switch, and when the switch is moved between engaged and disengaged positions the spring can be compressed generating a rotational bias on the switch urging the switch toward either the engaged or disengaged position.

20 Claims, 26 Drawing Sheets

(56) References Cited

U.S. PATENT DOCUMENTS 3,355,833 A * 12/1967 Ruger ..... F41A 15/08 42/23
3,457,383 A * 7/1969 Griffin ..... H01H 9/06 200/275
3,748,730 A * 7/1973 Bartram ..... B26B 19/38 30/43.1
3,781,988 A * 1/1974 Jones ..... B26B 29/02 30/2
4,011,741 A * 3/1977 Nolin ..... E05B 59/00 70/107
4,693,228 A * 9/1987 Simonds ..... F41B 5/1469 124/25
5,262,678 A * 11/1993 Flowers ..... H01H 3/0213 200/335
5,596,808 A * 1/1997 Lake ..... B26B 1/044 30/160
5,802,722 A 9/1998 Maxey et al.
5,822,866 A 10/1998 Pardue
6,105,255 A 8/2000 Cheng
6,289,592 B1 9/2001 Emerson
6,397,477 B1 6/2002 Collins
6,427,335 B1 8/2002 Ralph
6,434,831 B2 8/2002 Chen
6,553,672 B2 4/2003 Glesser et al.
6,651,344 B2 11/2003 Cheng
6,668,460 B2 12/2003 Feng
6,701,621 B2 3/2004 Kain
6,810,588 B1 11/2004 Cheng
6,834,432 B1 12/2004 Taylor, Jr.
6,941,661 B2 9/2005 Frazer
6,959,494 B2 11/2005 Taylor
7,000,323 B1 2/2006 Hatcher et al.
7,059,053 B2 6/2006 Sakai
7,121,005 B2 10/2006 Hughes
7,146,736 B1 12/2006 Collins
7,165,329 B2 1/2007 Kao
7,243,430 B1 7/2007 Lerch
7,275,321 B2 10/2007 Cheng
7,278,213 B2 10/2007 Pardue et al.
7,302,760 B2 12/2007 Lake
7,305,768 B2 12/2007 Hinderer
7,313,866 B2 1/2008 Linn et al.
7,370,421 B2 5/2008 Onion et al.
7,437,822 B2 10/2008 Flagg et al.
7,458,159 B2 12/2008 Galyean et al.
7,513,044 B2 4/2009 Lake
7,536,788 B2 5/2009 VanHoy et al.
7,543,386 B2 * 6/2009 Sullivan ..... B26B 1/046 30/160
7,555,839 B2 7/2009 Koelewyn
7,562,454 B2 7/2009 Steigerwalt
7,603,778 B1 10/2009 Lerch
7,676,931 B2 3/2010 Knight et al.
7,676,932 B2 3/2010 Grice et al.
7,748,122 B2 7/2010 Duey
7,774,940 B2 8/2010 Frank
7,854,067 B2 12/2010 Lake
7,987,601 B2 8/2011 Nakamura
8,001,693 B2 8/2011 Onion
RE42,906 E 11/2011 Onion
8,291,597 B2 10/2012 Hawk et al.
8,307,555 B2 11/2012 Onion
8,375,589 B2 2/2013 Bremer
8,375,590 B2 2/2013 Duey
8,490,288 B1 * 7/2013 Mollick ..... B26B 1/046 30/155
8,499,460 B1 8/2013 Pearman
8,499,461 B1 * 8/2013 Mollick ..... B26B 1/046 30/160
8,572,851 B2 11/2013 Duey
8,683,702 B2 1/2014 Lo
8,813,366 B2 8/2014 Chen
8,863,393 B2 10/2014 Chen
8,863,394 B2 10/2014 Lo
8,966,768 B2 3/2015 Onion
9,120,234 B2 9/2015 MacNair et al.
9,138,903 B2 9/2015 Vellekamp
9,242,383 B2 1/2016 Drai
9,302,399 B2 4/2016 Kao
9,327,413 B2 5/2016 Sakai
9,339,681 B1 * 5/2016 Nalley ..... A63B 21/063
9,346,176 B2 5/2016 Collins et al.
9,352,473 B2 5/2016 Harvey
9,364,957 B2 6/2016 Lake
9,387,595 B2 7/2016 Ikoma
9,505,141 B2 11/2016 Duey
9,527,218 B2 12/2016 Valdez
9,579,807 B2 2/2017 Chu et al.
9,737,997 B1 * 8/2017 Marfione ..... B26B 1/04
9,878,455 B1 * 1/2018 Perez ..... B26B 1/00
9,943,970 B2 4/2018 Glesser
9,975,259 B2 5/2018 Liu
10,035,272 B2 7/2018 Bruhns
10,071,489 B2 9/2018 MacNair et al.
2001/0052187 A1 12/2001 Eickhom
2004/0154170 A1 * 8/2004 Kain ..... B26B 1/046 30/161
2005/0183268 A1 8/2005 Chen
2006/0064877 A1 3/2006 Vallotton et al.
2006/0113444 A1 * 6/2006 Parsons ..... E04H 17/263 248/274.1
2006/0260137 A1 * 11/2006 Flagg ..... B26B 1/044 30/160
2006/0260138 A1 * 11/2006 VanHoy ..... B26B 1/044 30/161
2007/0186420 A1 * 8/2007 Koelewyn ..... B26B 1/046 30/153
2008/0172884 A1 7/2008 Cheng
2014/0360023 A1 * 12/2014 Lake ..... B26B 1/044 30/161
2017/0066144 A1 3/2017 Ohlrich
2017/0066145 A1 3/2017 Cheung
2017/0136634 A1 * 5/2017 Kao ..... B26B 1/042
2017/0165849 A1 6/2017 DeBaker
2017/0232622 A1 * 8/2017 Bruhns ..... B26B 1/044 30/161
2017/0333069 A1 * 11/2017 Vodinh ..... B26B 29/02
2018/0021963 A1 1/2018 Liao
2018/0065259 A1 3/2018 Gibbs
2018/0169875 A1 6/2018 Valdez

OTHER PUBLICATIONS

Carl Kammerling International Ltd., "Folding Utility Knife", "Retrieved from http://www.ck-tools.com/products/ck_tools/sawing_cutting/trimming_knives/folding_utility_knife", Known to exist as early as Dec. 4, 2018, p. 1.
Coast Products, Inc., "DX311", "Retrieved from https://coastportland.com/product/dx311/", Known to exist as early as Dec. 4, 2018, p. 2.
Columbia River Knife and Tool, "Homefront", "Retrieved from https://www.crkt.com/homefront.html", Known to exist as early as Dec. 4, 2018, p. 3.
SOG Specialty Knives & Tools, LLC, "Flash II Black Serrated", "Retrieved from https://www.sogknives.com/type/knives/flash-ii-partially-serrated-black-tini-clam-pack.html", Known to exist as early as Dec. 4, 2018, p. 5.
SOG Specialty Knives & Tools, LLC, "Kiku Assisted Satin", "Retrieved from https://www.sogknives.com/type/knives/kiku-assisted-satin.html", Known to exist as early as Dec. 4, 2018, p. 4.
Moon, Will, "The First Moon MK12 Heading Out!", "Retrieved from http://willmooncustomknives.blogspot.com/2012/12/the-first-moon-mk12-heading-out.html", Dec. 4, 2012, p. 1 Published in: US.
Ontario Knife, "Product Detail: Carter Knife", "Known to exist as early as Dec. 4, 2018", p. 1, Publisher: Retrieved from https://web.archive.org/web/20181018084603/http://ontarioknife.com/carter-prime.html.

(56) References Cited

OTHER PUBLICATIONS

CRKT Official, "CRKT LAWKS—Lake and Walker Knife Safety System—How To Use", Jul. 22, 2009, p. 2, Publisher: Retrieved from https://www.youtube.com/watch?v=1sfm3TWB1hQ.

* cited by examiner

FOLDING KNIFE

CLAIM OF PRIORITY UNDER 35 U.S.C. § 119

The present Application for Patent claims priority to Provisional Application No. 62/781,518 entitled "FOLDING KNIFE" filed Dec. 18, 2018, and the present Application claims priority to Provisional Application No. 62/785,730 entitled "FOLDING KNIFE" filed Dec. 28, 2018, both assigned to the assignee hereof and hereby expressly incorporated by reference herein.

FIELD OF THE DISCLOSURE

The present disclosure relates generally to folding knives. In particular, but not by way of limitation, the present disclosure relates to systems, methods and apparatuses for locking features of folding knives.

DESCRIPTION OF RELATED ART

Folding knives have been used for centuries by craftsmen, hunters, and others requiring a sharp cutting instrument. In an open or extended position, the knife cutting blade is extended to expose the blade cutting edge and permit cutting therein. In a closed position, the cutting edge of the blade is stored within a cavity or recess in the handle portion of the knife, thus preventing the blade from being exposed and acting as its own sheath. The folding knife further provides a cutting instrument which is much shorter in length than a typical fixed blade knife.

Although these types of knives are extremely convenient, they can potentially become dangerous if the cutting blade does not have a locking mechanism to securely keep the knife blade in the first extended position of use. Two popular types of such locks include the lock back and the liner lock. The lock back structure provides a spring-biased lever mounted along one side of a handle. The lever has a front hook or tooth that engages in a notch in the tang portion of the blade, adjacent to the point of pivotal attachment of the blade to the handle. The liner lock structure provides a thin liner of sheet metal that springs into place behind a flat portion of the tang of the blade, thereby preventing closure until the liner is manually moved out of the way of the blade.

Despite the popularity of these structures, there still are instances of lock failure or, more often, inadvertent releasing of the lock. Another problem is a lock which requires or encourages the user to have a finger or part of his or her hand in the path of a closing blade when the release mechanism is actuated, because of the arrangement of the parts and the actions necessary for releasing the lock.

U.S. Pat. No. 7,437,822 to Flagg discloses a liner lock with a spring-biased rotating safety mechanism, where the spring is arranged in a separate recess in the handle than the safety mechanism and is outside of the safety mechanism. Further, the spring only biases the safety mechanism toward the safe position such that the safety mechanism cannot remain in the release position unless the user physically holds the safety mechanism in the release position. Additionally, the spring force is greatest when the safety mechanism is in the release position. This patent is incorporated by reference herein in its entirety. U.S. Pat. No. 6,751,868 to Glesser discloses a folding knife with a substantially spherical locking mechanism, and is incorporated by reference herein in its entirety. U.S. Pat. No. 9,120,234 to Kai discloses a folding knife with a lockbar separate from the frame/handle, and is incorporated by reference herein in its entirety. U.S. Pat. No. 8,161,653 to Nenadic discloses a rotatable locking mechanism, and is incorporated by reference herein in its entirety. U.S. Pat. No. 9,862,105 to Liang discloses a handle lock with a safety that traverses the handle linearly parallel to a direction of the blade when extended, and is incorporated by reference herein in its entirety. U.S. Pat. No. 9,943,970 to Glesser discloses a rotatable locking wedge, and is incorporated by reference herein in its entirety. U.S. Pat. Pub. No. 2017/0334077 to Onion discloses a rotatable switch on an opposing side of a knife frame from a frame lock that locks a pivot axis but does not interact with the frame lock, and is incorporated by reference herein in its entirety. U.S. Pat. No. 10,071,489 to MacNair discloses a lockbar having a puck for engagement with the blade's tang, and is incorporated by reference herein in its entirety.

It is well known that certain metals and other materials experience greater dynamic friction when surface movement between two objects occurs. In the case of a handle lock on a folding knife, the handle and thus the handle lock is often formed from aluminum or titanium, metals that feel "sticky" when moved across the tang of a steel blade. Thus, there is a need for a folding knife handle lock that is less "sticky" but still formed from common metals.

SUMMARY OF THE DISCLOSURE

This disclosure describes systems, methods, and apparatus for a locking folding knife having a handle lock and a safety switch arranged around and rotatable around a pivot axis of the knife. In an engaged position the switch overlaps at least a portion of the handle lock and prevents it from moving into an unlocked position. A spring, such as a wire form spring, can be arranged within a pocket of the switch, and when the switch is moved between engaged and disengaged positions the spring can be compressed generating a rotational bias on the switch urging the switch toward either the engaged or disengaged position. The spring can include a first and second end, where the first end can rest within and rotate within a curved pocket in a protrusion of the handle while the second end can rest within a sub-pocket of the pocket of the switch.

Some embodiments of the disclosure may be characterized as a locking folding knife comprising a handle, pivot axis, blade, locking mechanism, and a switch. The blade can have a cutting edge and a tang and the blade can be pivotably coupled to the handle such that the blade is pivotable relative to the handle about the pivot axis between a retracted position and an extended position. The cutting edge can be exposed in the extended position and a portion of the blade can be received within the handle in the retracted position. The locking mechanism can include a handle lock in the handle, or a liner, and can be biased to a locked position contacting the tang of the blade when the blade is in the extended position for preventing the blade from closing when in the extended position. The switch can be located in a first recess in the handle surrounding the pivot axis and the switch can be operable to pivot about the pivot axis between an engaged and a disengaged position. When the switch is pivoted to the engaged position it can block movement of the handle lock into the unlocked position. When the switch is pivoted to the disengaged position, the handle lock may be free to move into the unlocked position.

Other embodiments of the disclosure may also be characterized as a locking folding knife including a frame and a rotatable switch. The frame can have a first side and a second side, and optionally a liner, and the first side can be split into a fixed portion and a handle lock that flexes between a locked and an unlocked position. The handle lock can be biased to the locked position. The rotatable switch can be mounted to the frame and can be rotatable around a pivot axis of the lockable folding knife. The rotatable switch can have an engaged and a disengaged position, wherein in the engaged position the rotatable switch is at least partially arranged over the handle lock thereby preventing the handle lock from moving to its unlocked position. Also, in the disengaged position the rotatable switch can be misaligned with all portions of the handle lock thereby allowing the handle lock to be moved between its locked and unlocked positions.

Other embodiments of the disclosure can be characterized as a method of manufacturing a lockable folding knife. The method can include forming a blade, forming a frame, forming a slit in a first side of the frame, rotatably affixing the blade to the frame at a pivot axis of the lockable folding knife, forming a rotatable switch, and mounting the rotatable switch to the frame. The slit in the first side of the frame can split the first side into a non-movable portion and a flexible portion that is movable between a locked and an unlocked position and is biased toward the locked position. The mounting of the rotatable switch can include mounting the rotatable switching in a rotating manner at the pivot axis. The rotatable switch can include an engaged and a disengaged position, wherein in the engaged position the rotatable switch is arranged over at least a portion of the flexible portion thereby preventing the flexible portion from moving to its unlocked position, and wherein in the disengaged position the rotatable switch is not arranged over any of the flexible portion. As a result the handle lock can be moved between its locked and its unlocked positions when the switch is in the disengaged position.

DETAILED DESCRIPTION

The word "exemplary" is used herein to mean "serving as an example, instance, or illustration." Any embodiment described herein as "exemplary" is not necessarily to be construed as preferred or advantageous over other embodiments.

The present disclosure relates generally to a folding knife. More specifically, but without limitation, the present disclosure relates to safety features for preventing a folding knife from inadvertently folding.

Various types of folding knives have been in use for many years due to the convenience and safety of being able to conceal the point and blade of a knife when it is not in use. A primary safety feature of folding knives has also existed for many years—namely, a mechanism to prevent the knife from inadvertently folding while in use. Folding knives, in contrast to fixed-blade knives such as kitchen knives, are often used in situations where they are transported, unfolded, and then used to cut or stab something. Such uses are common, for example, during hunting, camping, fishing, repairing or self-defense activities. In these use cases, there are a variety of circumstances that could cause the lock mechanism to fail or inadvertently unlock, thereby endangering the user.

Existing mechanisms for preventing knives from folding, such as springs, latches, and locks, can still sometimes be accidentally disengaged, or can wear down over time to the point that they become ineffective. The present disclosure provides a plurality of advantageous safety mechanisms. These mechanisms provide enhanced safety through the durability and tactile feel of the mechanisms themselves and the redundancy of mechanisms. The durability and tactile feel of the mechanisms may prevent wear in the first place and allow the user to easily feel when a safety feature is in its desired position. The redundancy of mechanisms may ensure that even in the event of a failure of one safety feature due to wear or breakage, another secondary safety feature may prevent an unsafe closure of the blade.

Figure 7A:
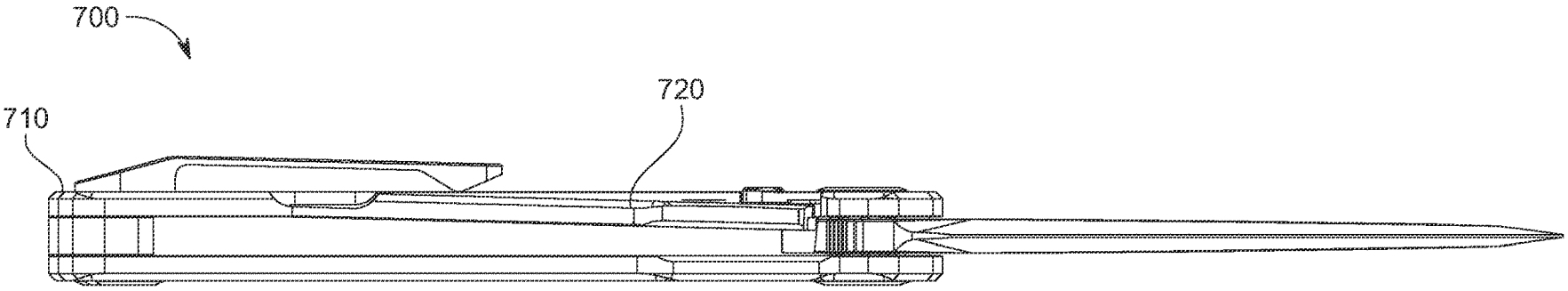
FIG. 7*a* shows a bottom view of the folding knife of FIG. 1.
Figure 7B:
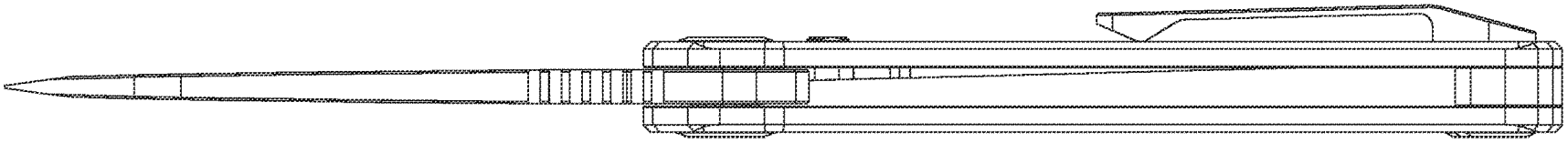
FIG. 7*b* shows a top view of the folding knife of FIG. 1.
Figure 8B:
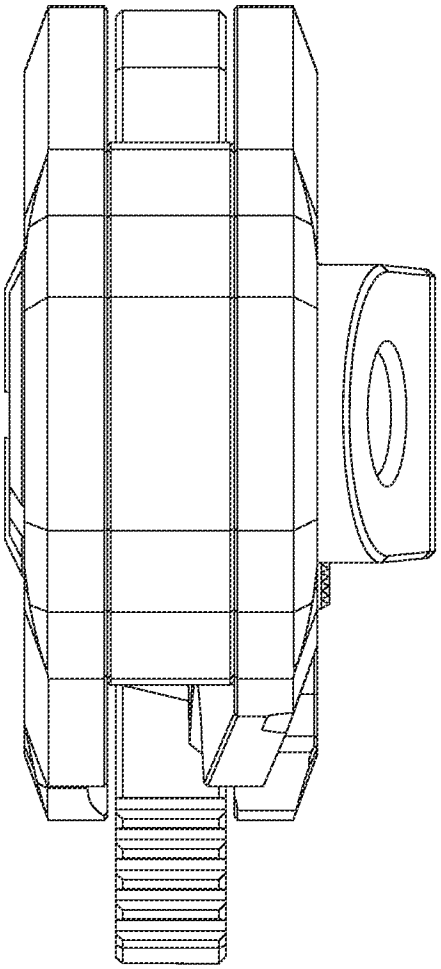
FIG. 8*b* shows a rear elevation view of the folding knife of FIG. 1.
Figure 8A:
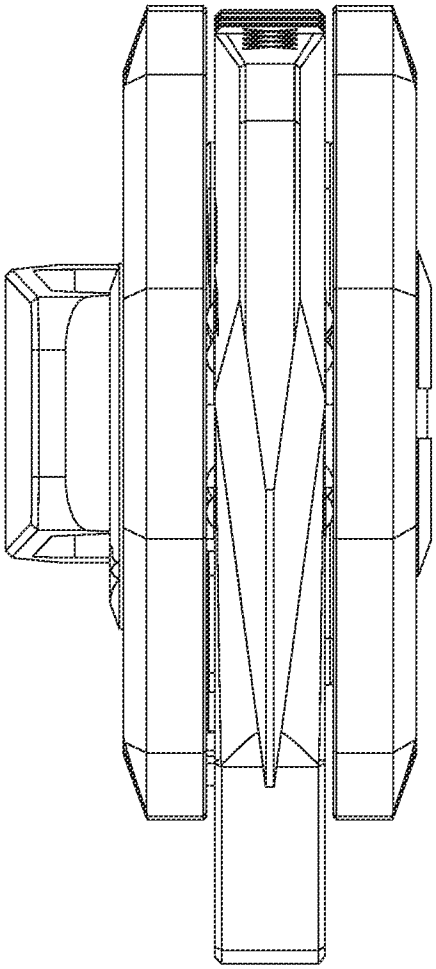
FIG. 8*a* shows a front elevation view of the folding knife of FIG. 1.
Figure 9:
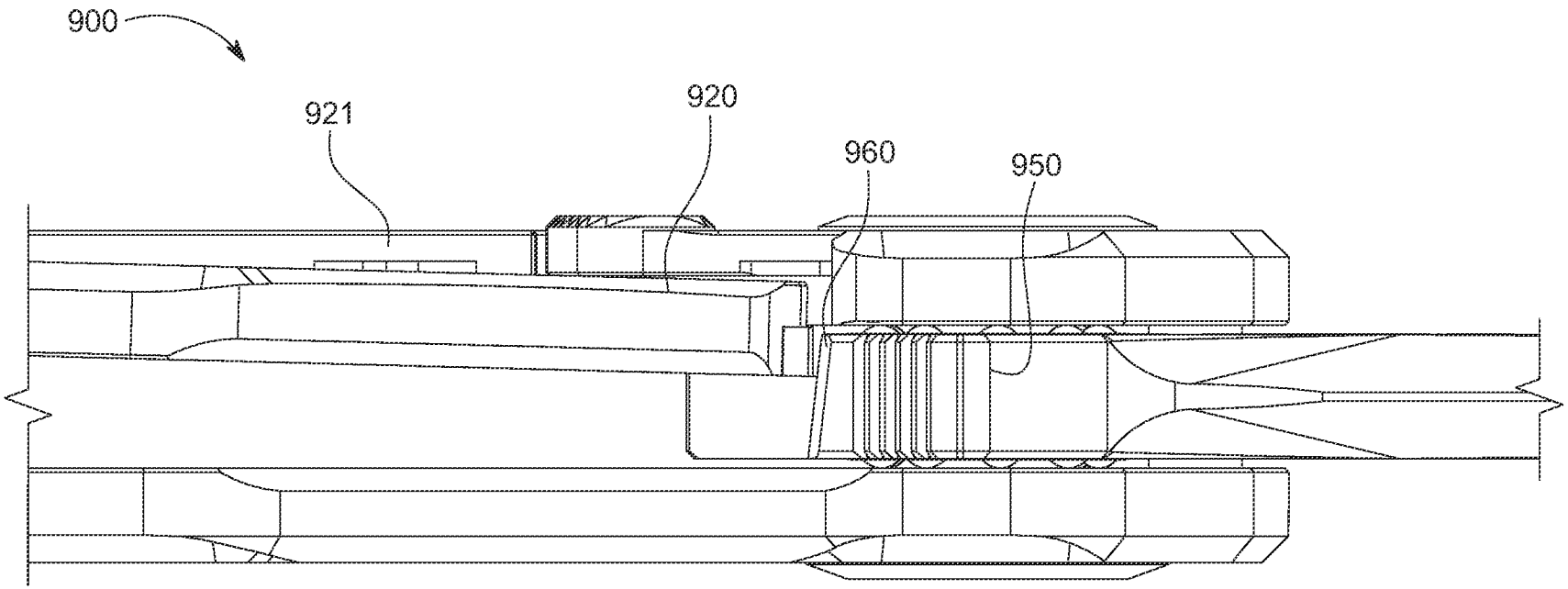
FIG. 9 shows a close-up view of a handle lock of the folding knife of FIG. 1 in an engaged position according to the present disclosure.

The herein disclosed embodiments include a first safety feature referred to herein as a "handle lock." The handle lock may be formed as part of the handle, from the shape of the handle itself providing the ability for the handle lock to flex relative to the rest of the handle. The handle lock (also referred to as a "handle lock portion," "lock bar," or "flexible portion") can be biased toward an opposing side of the folding knife such that when the blade is rotated out to an open or unfolded position, the handle lock moves toward an opposing handle and locks the blade in the unfolded position. The handle lock feature is best seen in FIGS. 7 and 9. FIG. 7A shows a bottom view of a folding knife 100 of the present disclosure with the blade fully extended and engaged. This position of the blade may be referred to throughout the disclosure as "unfolded" "extended," "engaged," or "locked," given that this full extension causes the handle lock 120 to engage the blade tang such that it is locked in the extended position. FIG. 9 shows a close-up view of the bottom of the knife 100 in its extended position. The handle lock portion 120 is shown engaged with a back end 153 of the blade tang 151.

The mechanism by which the handle lock engages with the blade tang can be the bias of the material from which the handle lock portion is formed. That is, its very shape may create the tension that pulls the handle lock portion into its natural position when the blade is extended. To disengage the handle lock portion, a user must apply pressure against the bias (away from the center of the handle toward the exterior of the handle) with the thumb of one hand and purposely move the blade with the other hand. The combination of these intentional motions by the user causes the handle lock portion 120 to move out of its locked position and allows the blade to rotate toward the closed position. When the blade tang is in its fully folded position, as best seen in FIGS. 16-20, the handle lock portion 120 is flush with the rest of the handle because the physical volume of the blade 150 pushes the handle lock portion out, against its natural bias and into the same plane as the non-movable portion 121 of the handle.

Figure 10:
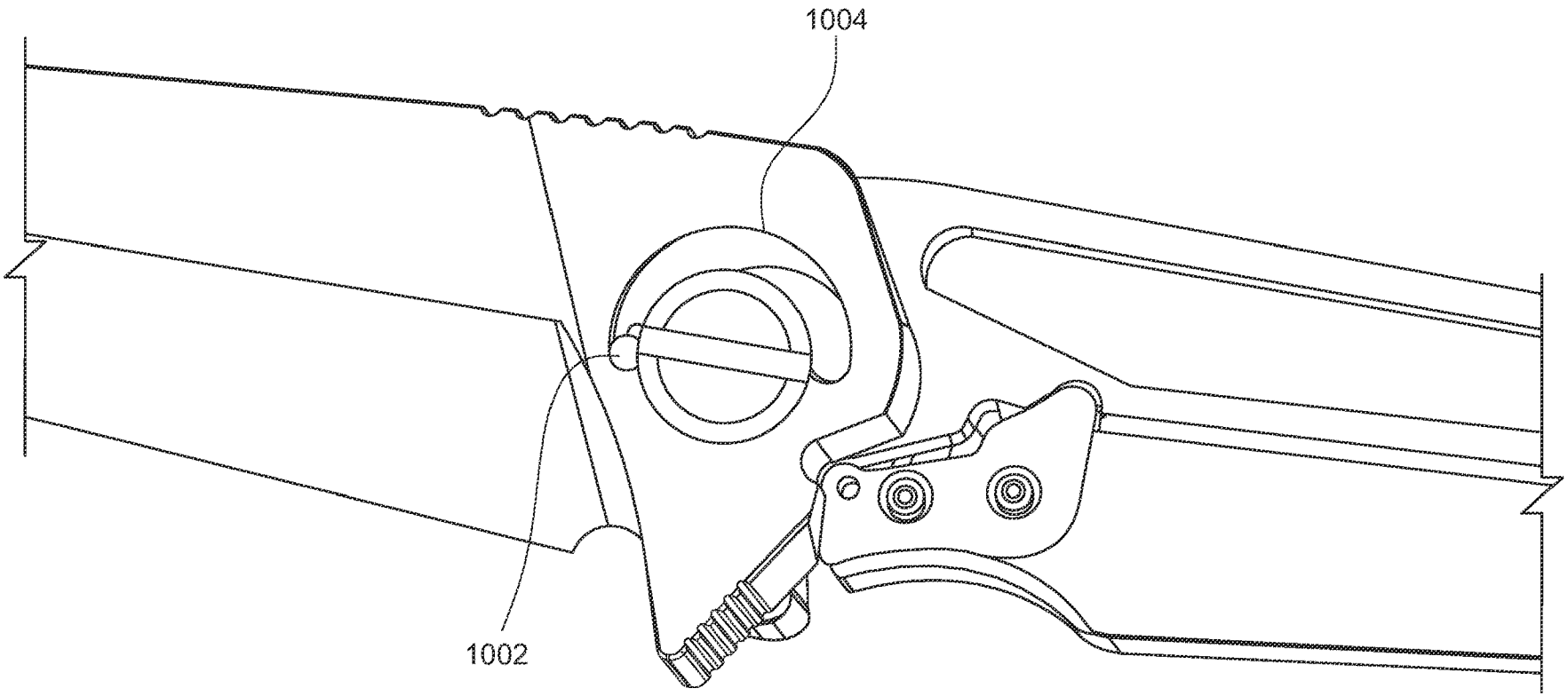
FIG. 10 shows the folding knife with a part of the handle hidden to reveal an embodiment of the interaction of a handle lock and tang of the blade as well as to show an embodiment of a reinforcement member.
Figure 15:
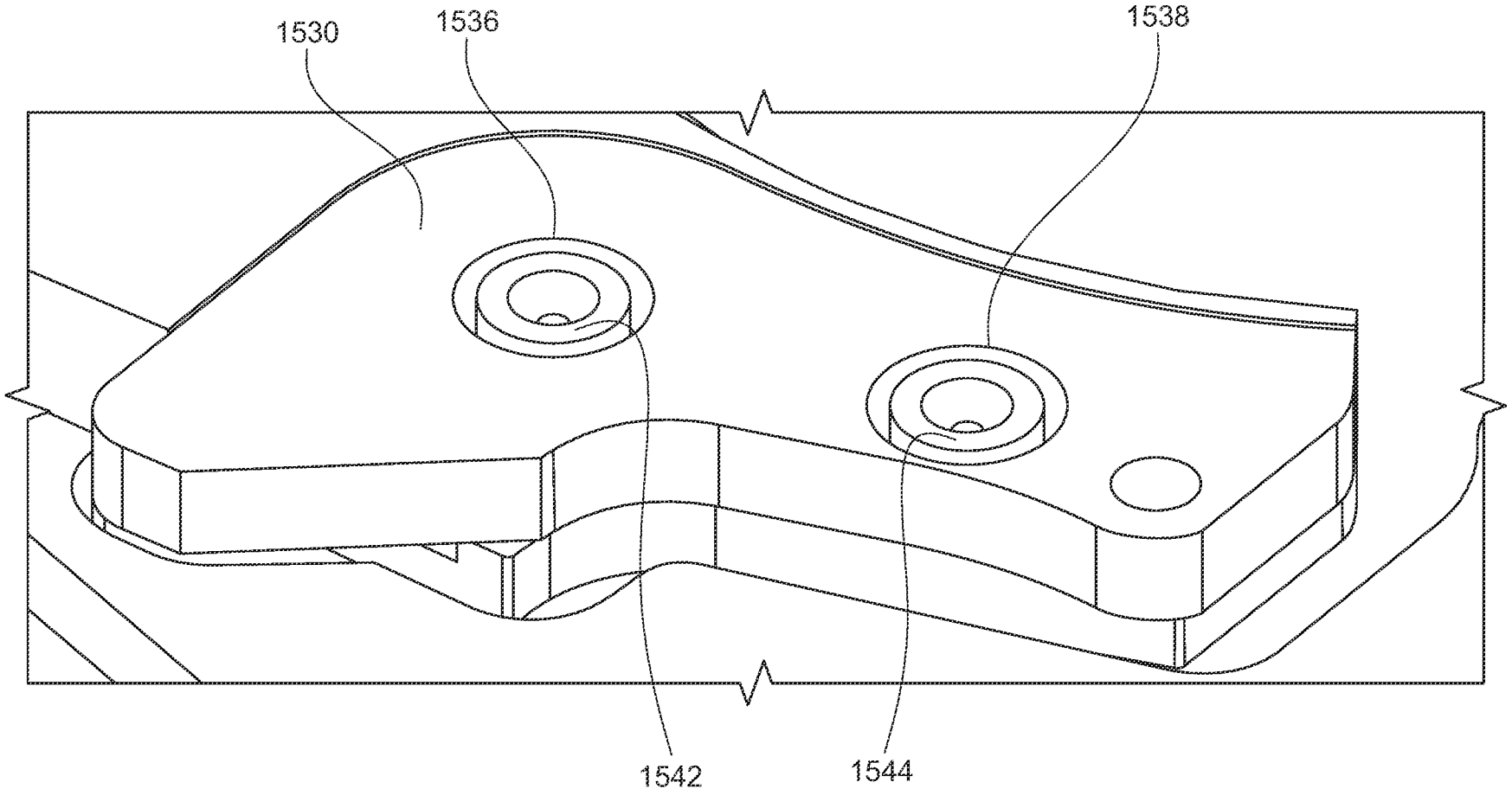
FIG. 15 shows a close-up view of the reinforcement mechanism of FIG. 10 having apertures and two posts of the handle lock engaged therewith.
Figure 16:
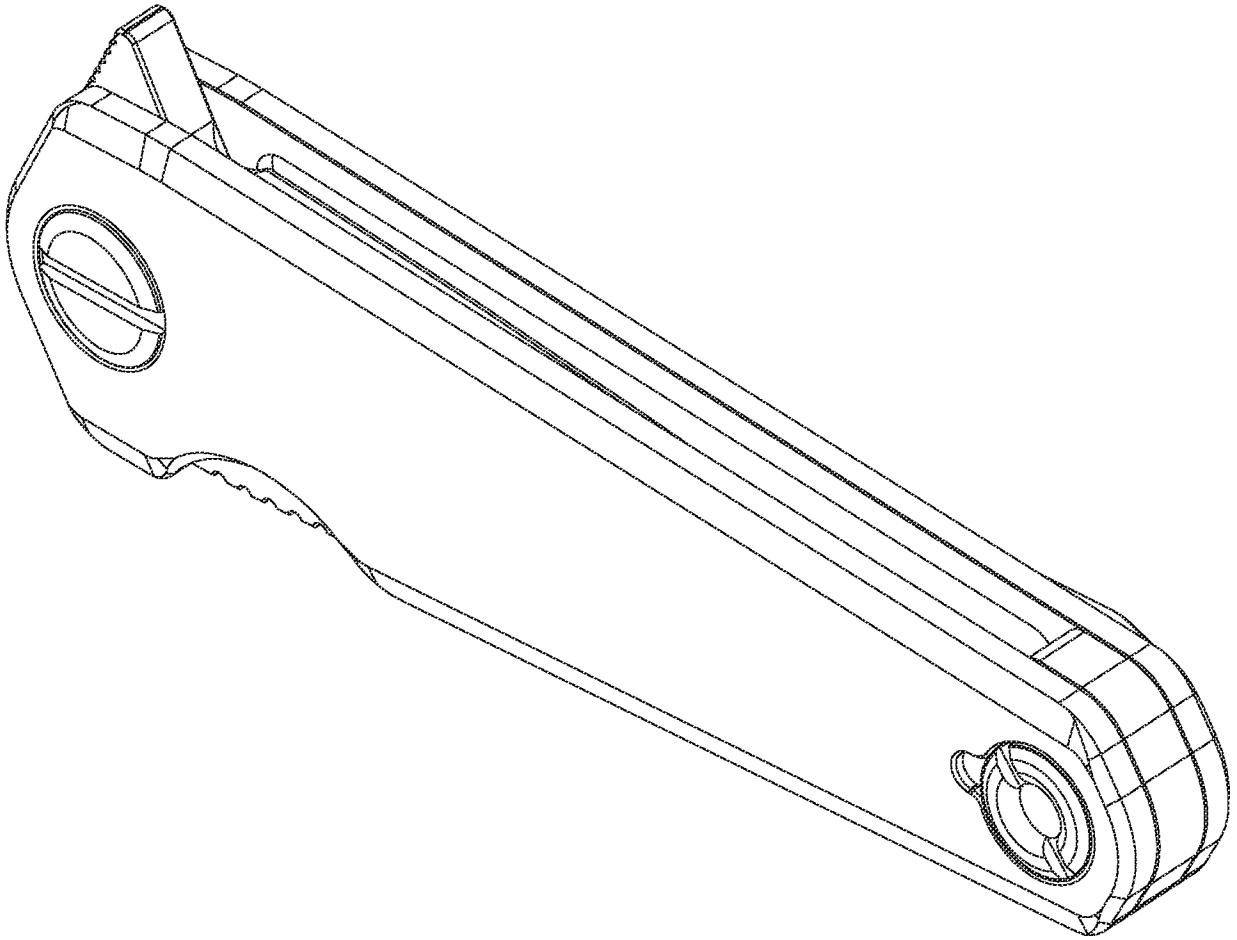
FIG. 16 shows a back top right view of the folding knife of FIG. 1 with the blade in the retracted position.
Figure 17:
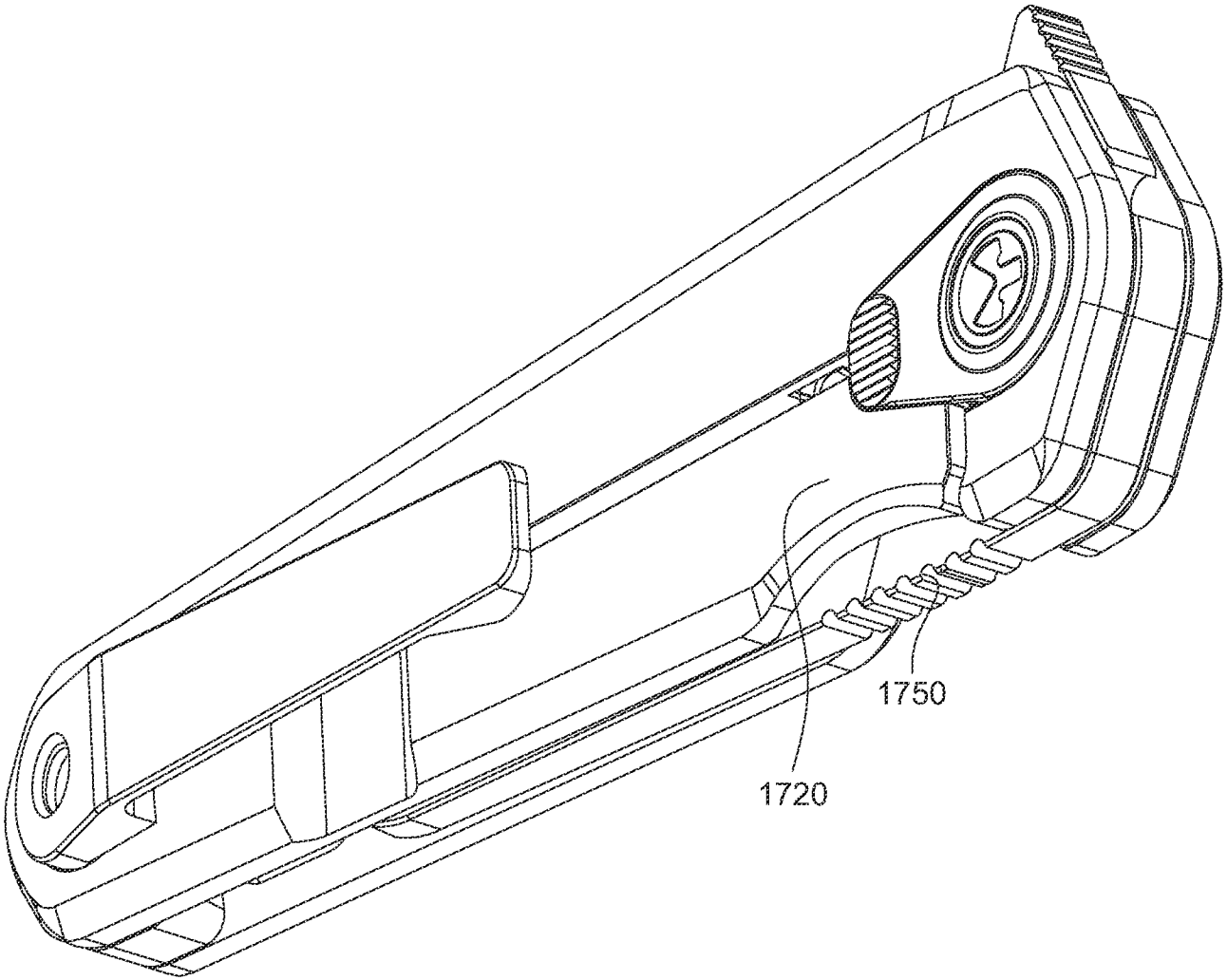
FIG. 17 shows a front bottom left perspective view of the folding knife of FIG. 1 with the safety toggle switch in a disengaged position.

The handle lock can include another safety feature referred to herein as a "reinforcement portion," which is best shown in the embodiment shown in FIGS. 10 and 15. This reinforcement portion 1030 adds strength to the handle lock portion and can be formed in manufacturing with one or more apertures through which a boss of the handle lock can pass. As shown in FIG. 15, each of the bosses 1042, 1044 (two are shown, but more or fewer than two can be implemented) can be deformed (or swaged) during assembly to lock the reinforcement portion to the handle lock portion. During assembly, the bosses can first start out as cylindrical, and then once the bosses have passed through the apertures 1036, 1038, the top may be deformed (or swaged) and somewhat flattened to fill a top space of the apertures such that the top deformed portion of the bosses holds the reinforcement portion to the handle lock portion and prevents the reinforcement portion's removal. The reinforcement member can be formed from a harder material than the handle, and can be shaped to interface with a somewhat vertical surface on the blade tang, thereby preventing closing of the blade when the blade is in the open position. This reinforcement member can also add durability to the handle lock feature to prevent wear. The reinforcement member can also be made from a different material, or be coated with a different material, than the rest of the handle lock, where this material has a lower coefficient of friction relative to the blade tang.

Figure 11:
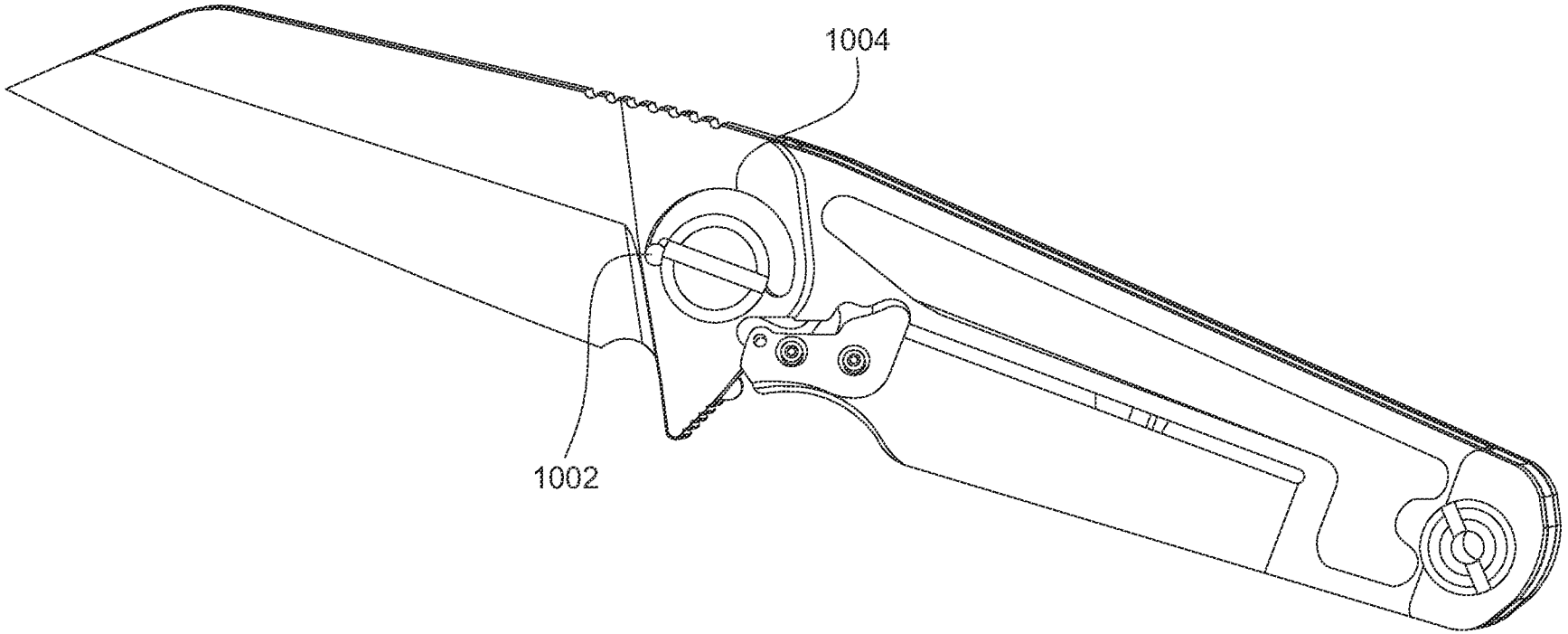
FIG. 11 shows another view of the folding knife of FIG. 10 with a part of the handle hidden.
Figure 13:
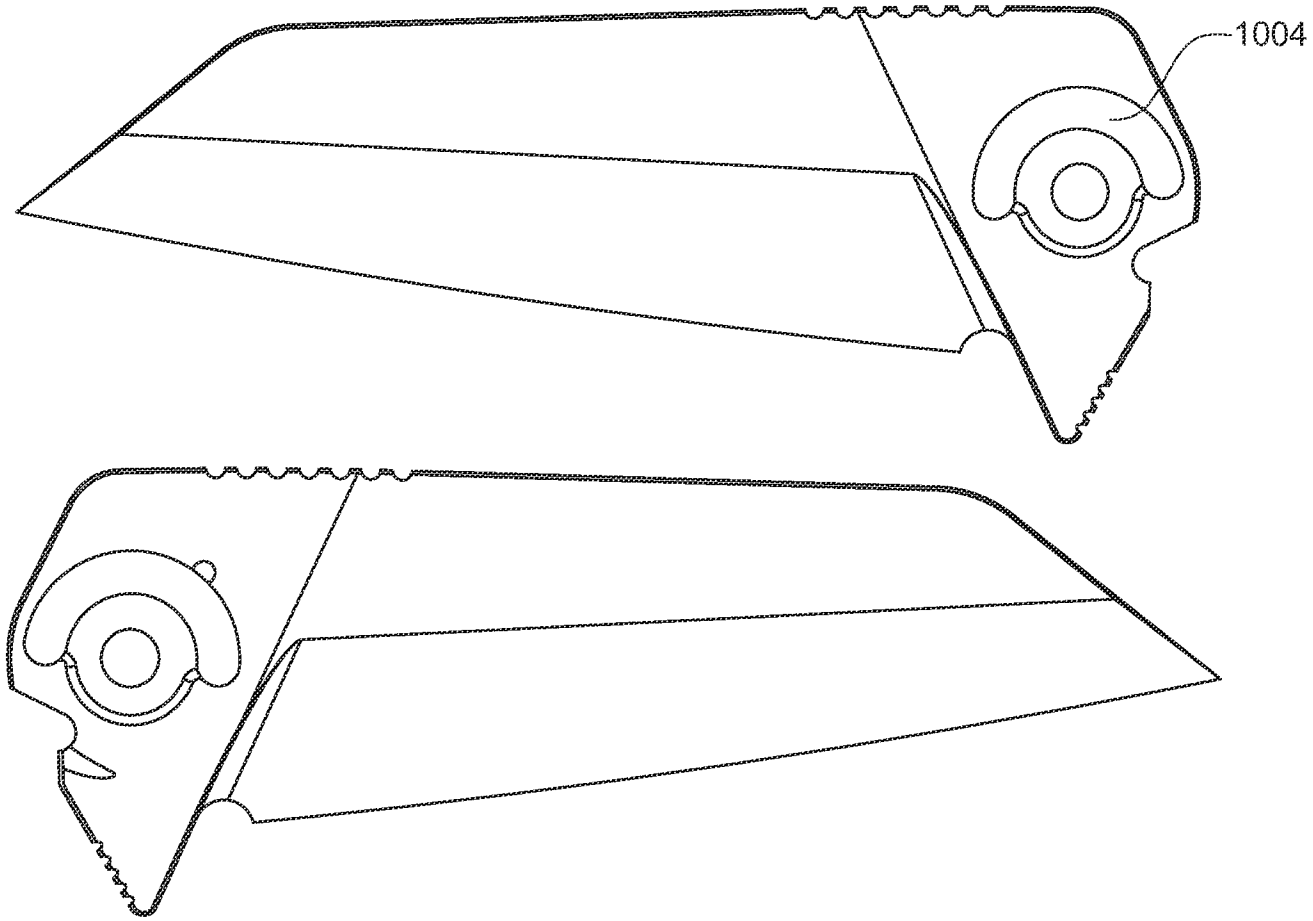
FIG. 13 shows a first and second side view of the blade of FIG. 10.
Figure 14:
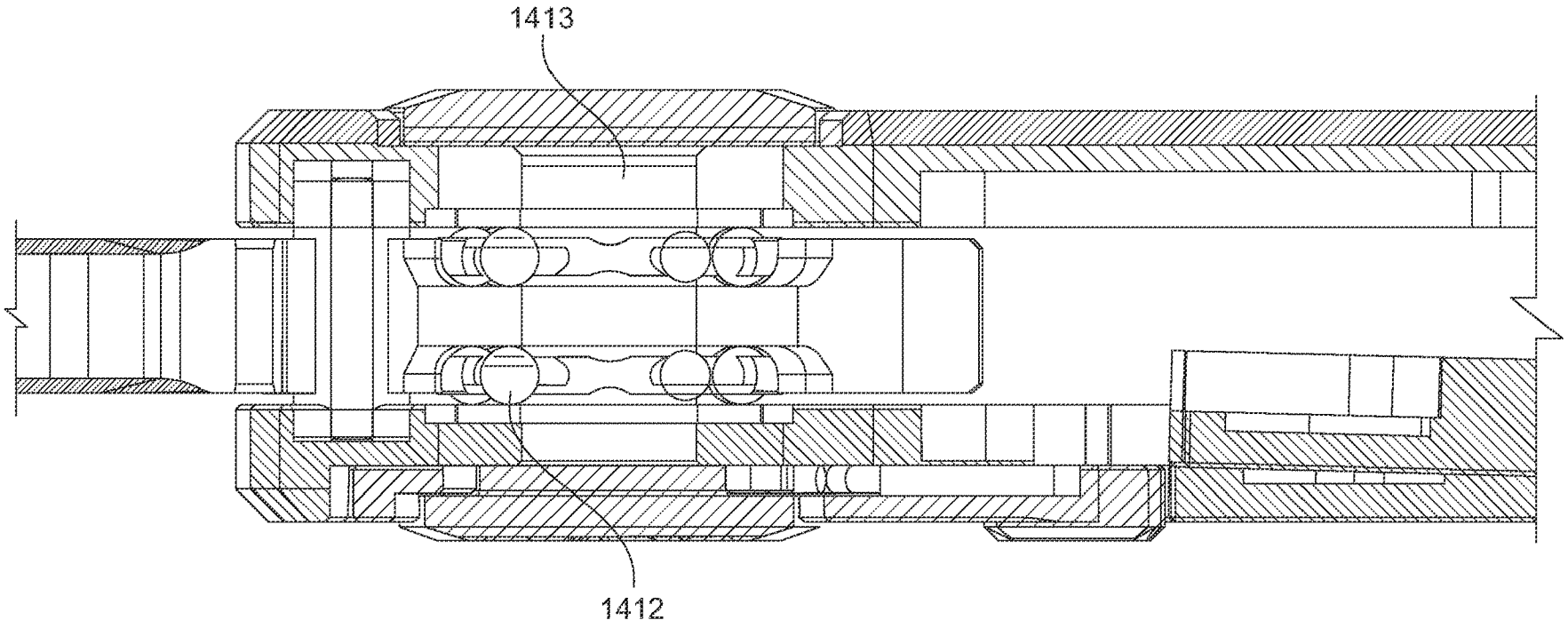
FIG. 14 shows a cross-sectional view from the top of the folding knife depicting the rotation mechanism of the blade.

FIG. 14 shows an embodiment of a cross-sectional view from the bottom of the knife depicting the rotating mechanism of the blade that allows it to move between its extended and folded positions. One or more ball bearings 1412 can provide a low-friction interface between the blade and the handle so that the blade can be rotationally guided via a blade stop (such as blade stop 102 in FIGS. 10 and 11) riding within a semicircular cutout in the blade (such as blade 104 in FIG. 13). The blade can pivot around a pivot mechanism 113.

Figure 1:
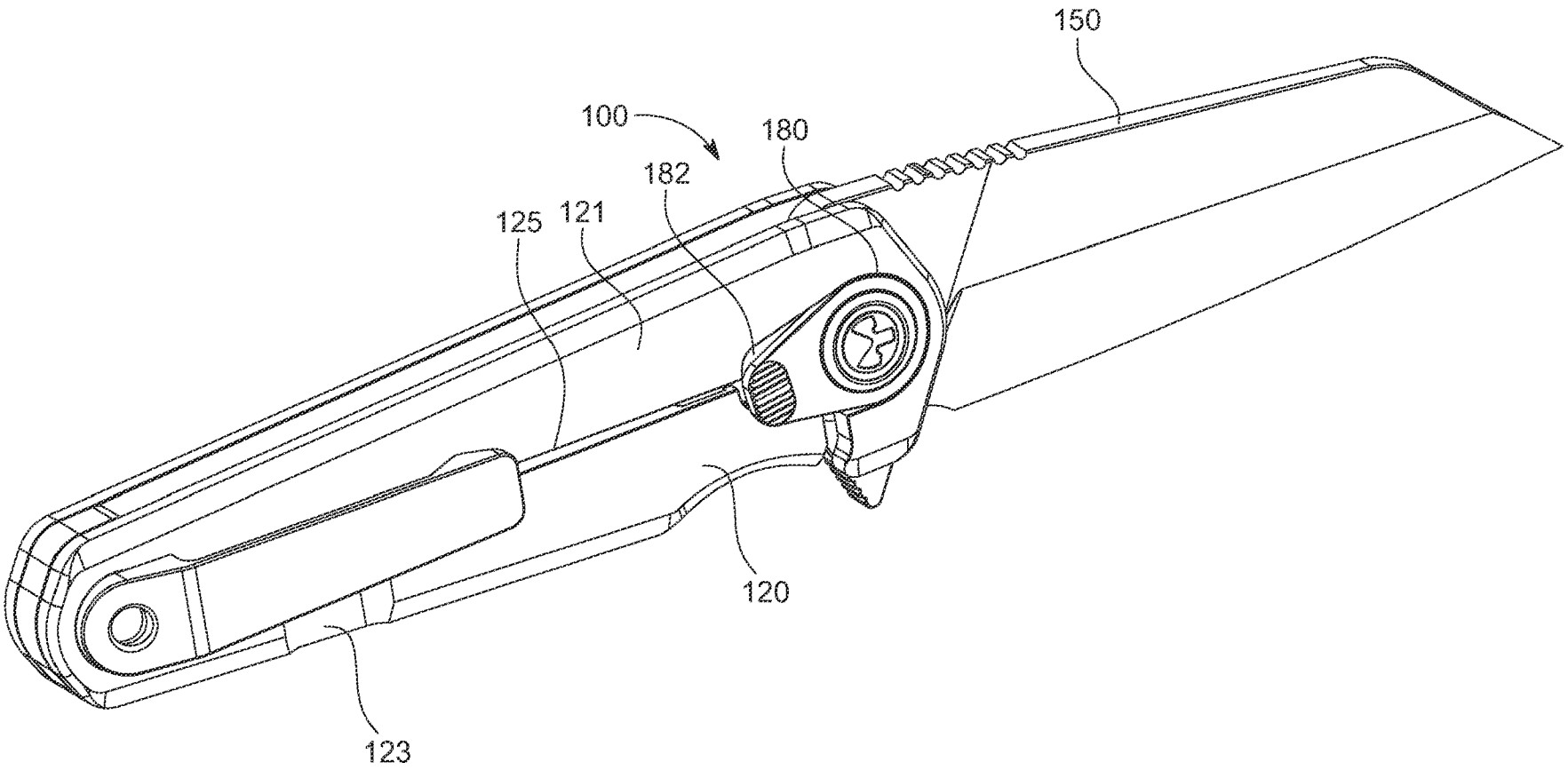
FIG. 1 is a perspective rear top left view of a folding knife according to the present disclosure.
Figure 2:
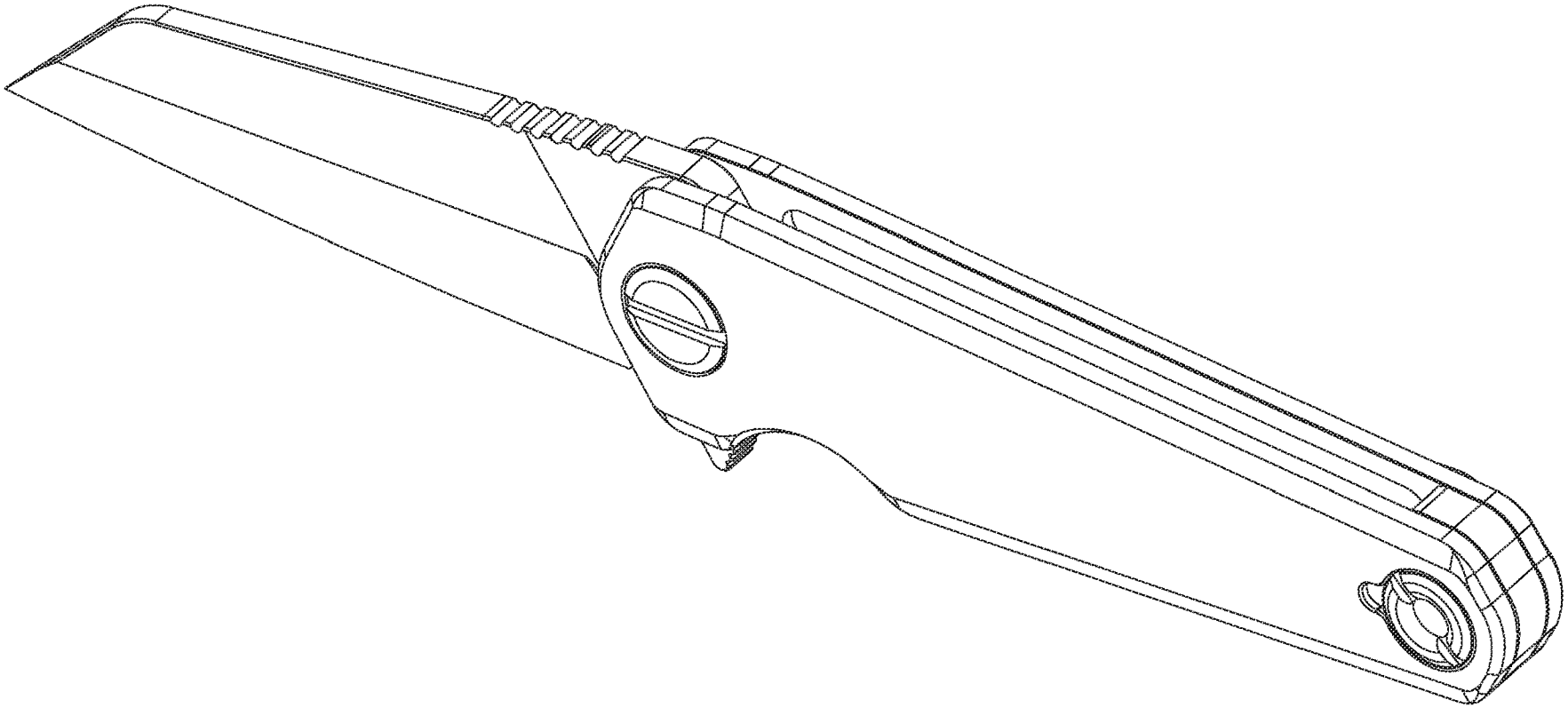
FIG. 2 is a perspective rear top right view of the folding knife of FIG. 1.
Figure 3:
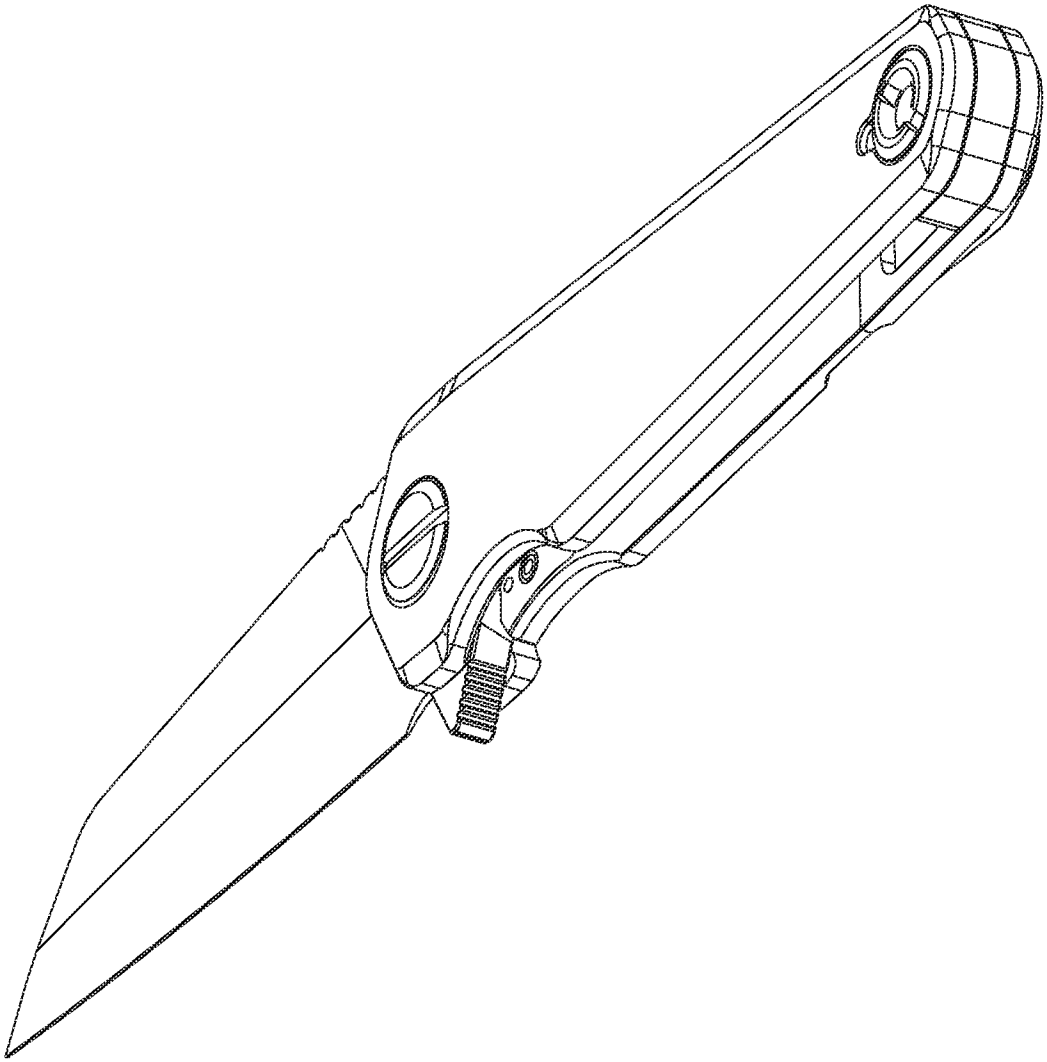
FIG. 3 is a perspective rear bottom right view of the folding knife of FIG. 1.
Figure 4:
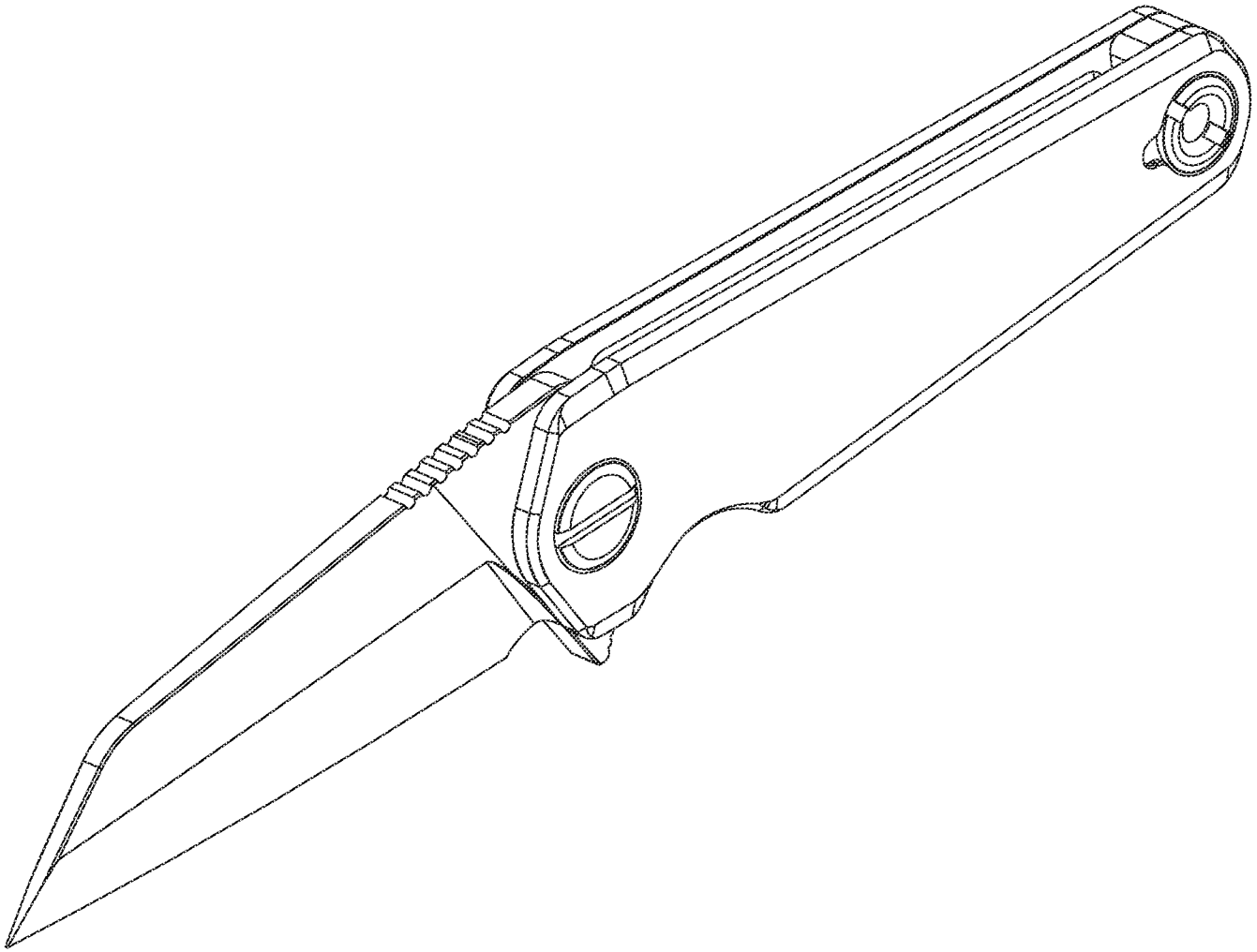
FIG. 4 is a perspective front top right view of the folding knife of FIG. 1.
Figure 5:
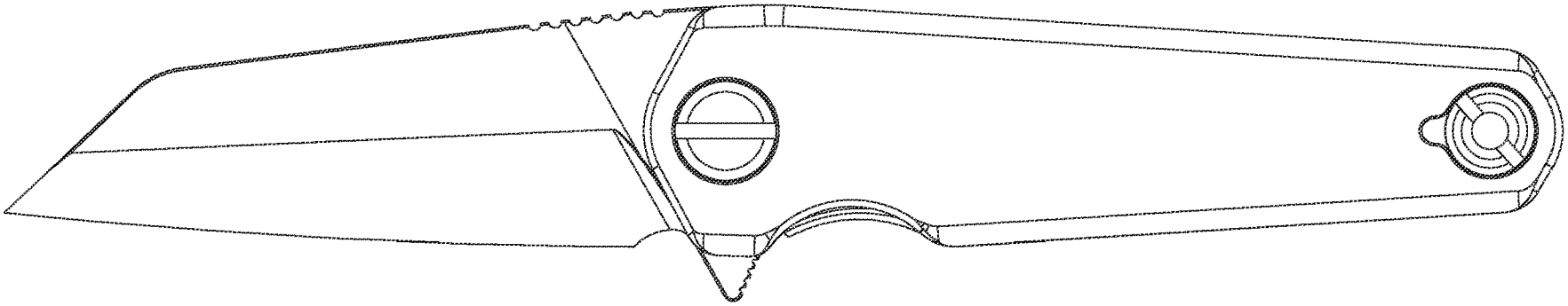
FIG. 5 is a right side elevation view of the folding knife of FIG. 1.
Figure 6:
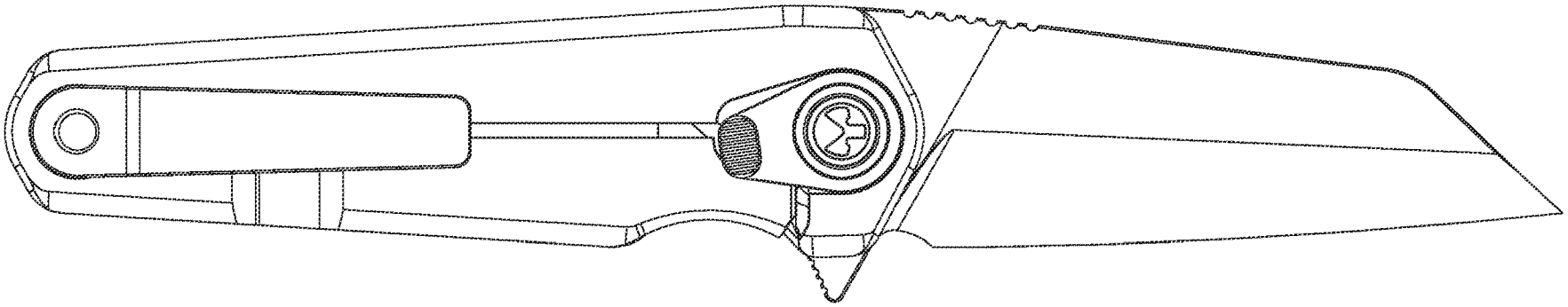
FIG. 6 is a left side elevation view of the folding knife of FIG. 1.
Figure 12:
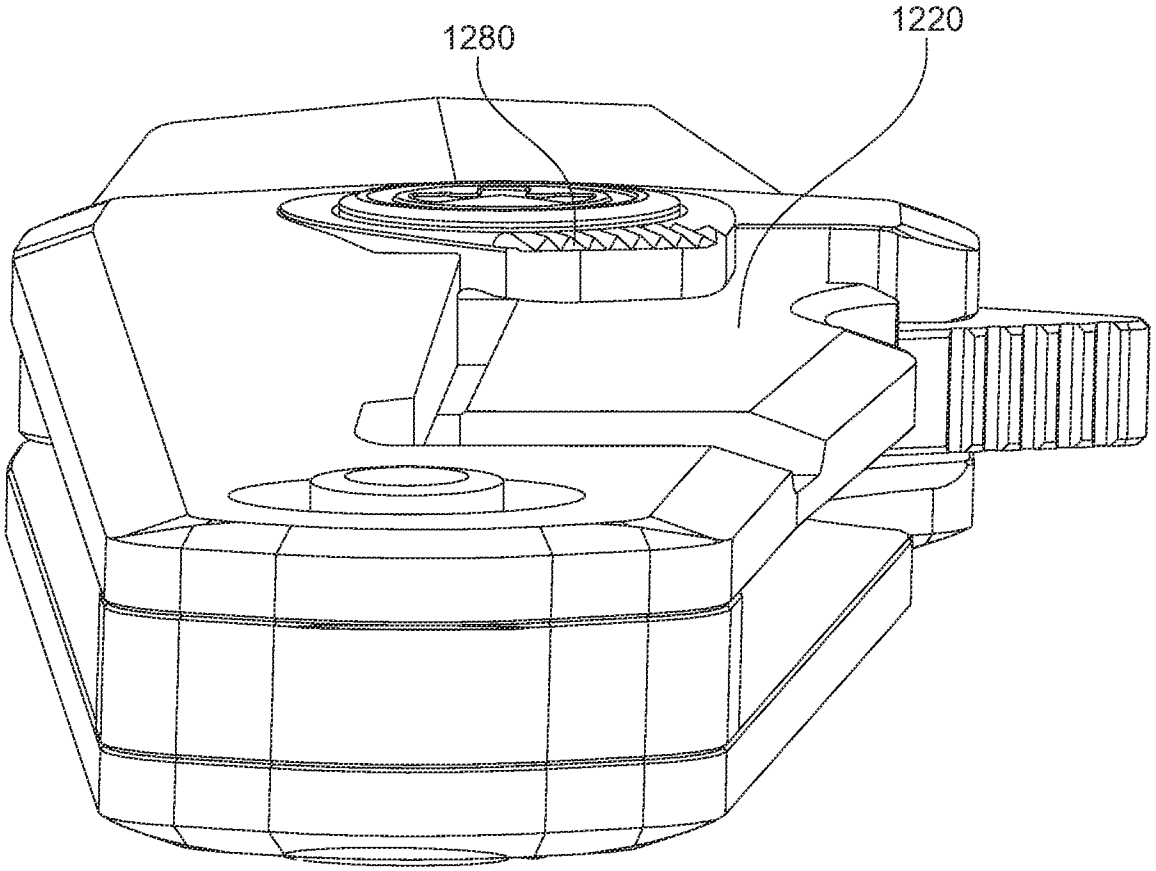
FIG. 12 shows a perspective view from the back of the folding knife of FIG. 1 depicting a handle lock portion in an engaged position and a safety toggle switch of the present disclosure in an engaged position.

The folding knife can also include another safety feature referred to herein as a "safety toggle switch" (or simply, "switch") configured to reside in either an engaged (i.e., "safe") or disengaged position, and can be rotationally biased throughout its range of movement—either toward the engaged or disengaged position depending on the switch's position. The rotational bias can force the switch to securely rest in the safe or unsafe position rather than to rest in between. The safety toggle switch is best shown in its safe or engaged position in FIGS. 1, 6, and 12. As shown in each of FIG. 1, when the blade 150 of the knife 100 is in its fully extended position and the handle lock portion 120 (or flexible portion) is engaged with a tang of the blade, the safety toggle switch 180, which can rotate within a switch cutout recess 182 (e.g., by around 15° or around 30° or around 45°), is situated in an engaged position within the switch cutout recess 182. The handle lock portion 120 can be unitary with a non-movable portion 121 and separated therefrom by a slit 125, where the handle lock portion 120 can include a hollow 123 that enhances its ability to flex relative to the non-movable portion 121. As shown in FIG. 12, in this engaged position, the switch 180 is positioned over at least a portion of the handle lock portion 120, preventing the handle lock portion 120 from being moved out of its locked position. This safety toggle switch 180 therefore prevents any accidental disengagement of the handle lock 120 that may occur if upward pressure were to be inadvertently applied against the bias of the handle lock 120. Further, the safety toggle switch 180 prevents the handle lock 120 from moving if the bias tension is diminished from wear or metal fatigue over time.

Figure 18:
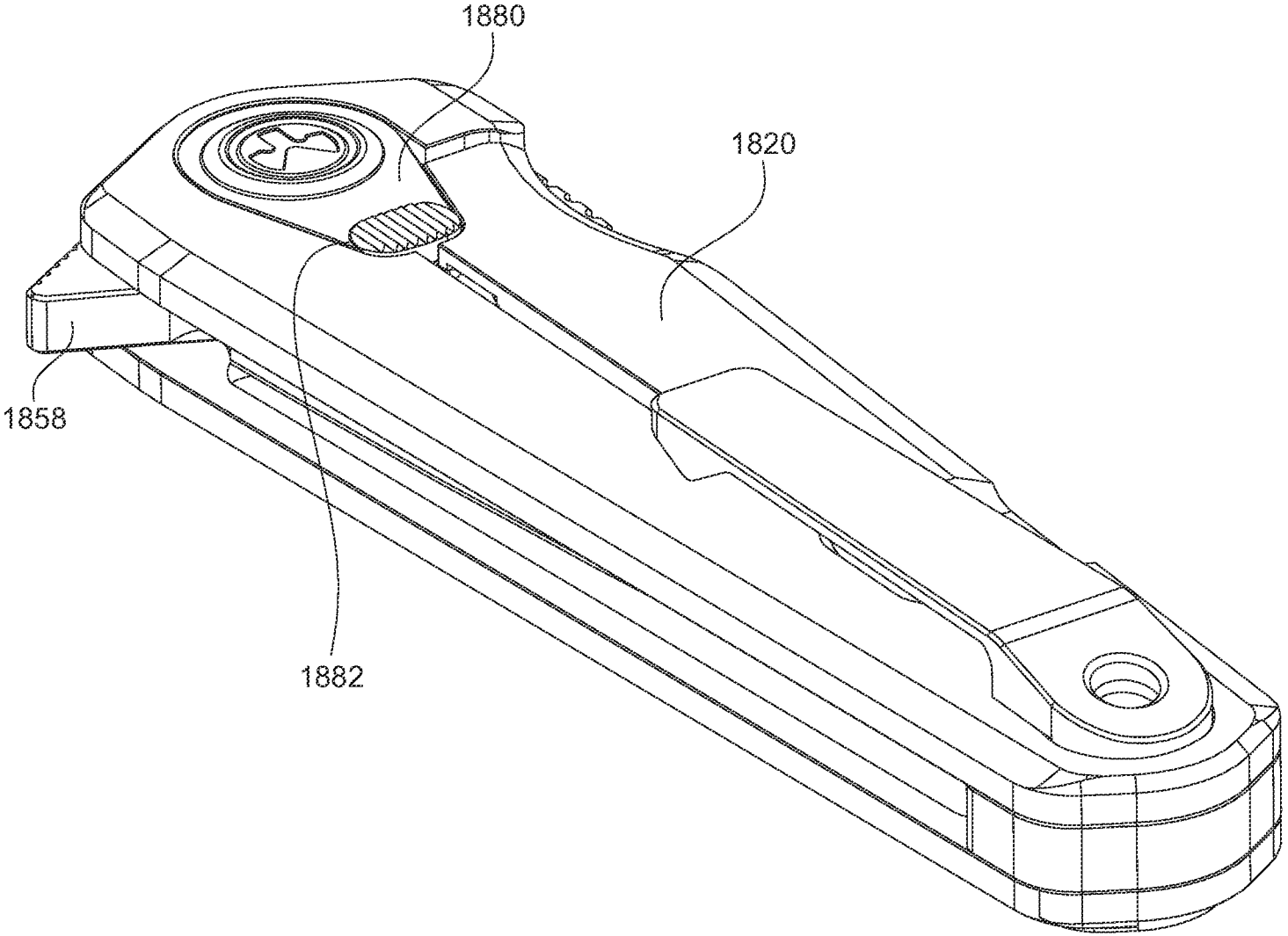
FIG. 18 shows a top rear left perspective rear view of the folding knife of FIG. 1 with the blade in the retracted position.
Figure 19:
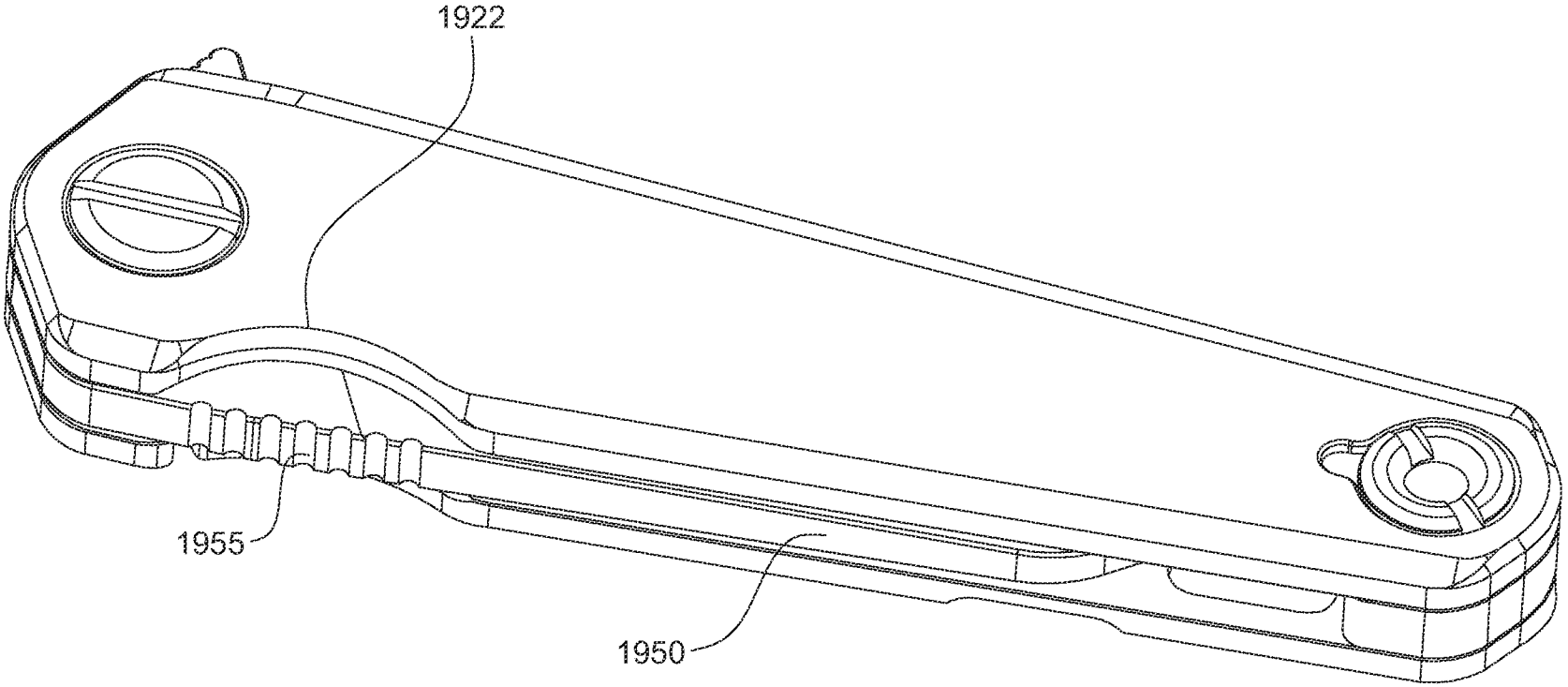
FIG. 19 shows a bottom right middle perspective front view of the folding knife of FIG. 1 with the blade in the retracted position.
Figure 20:
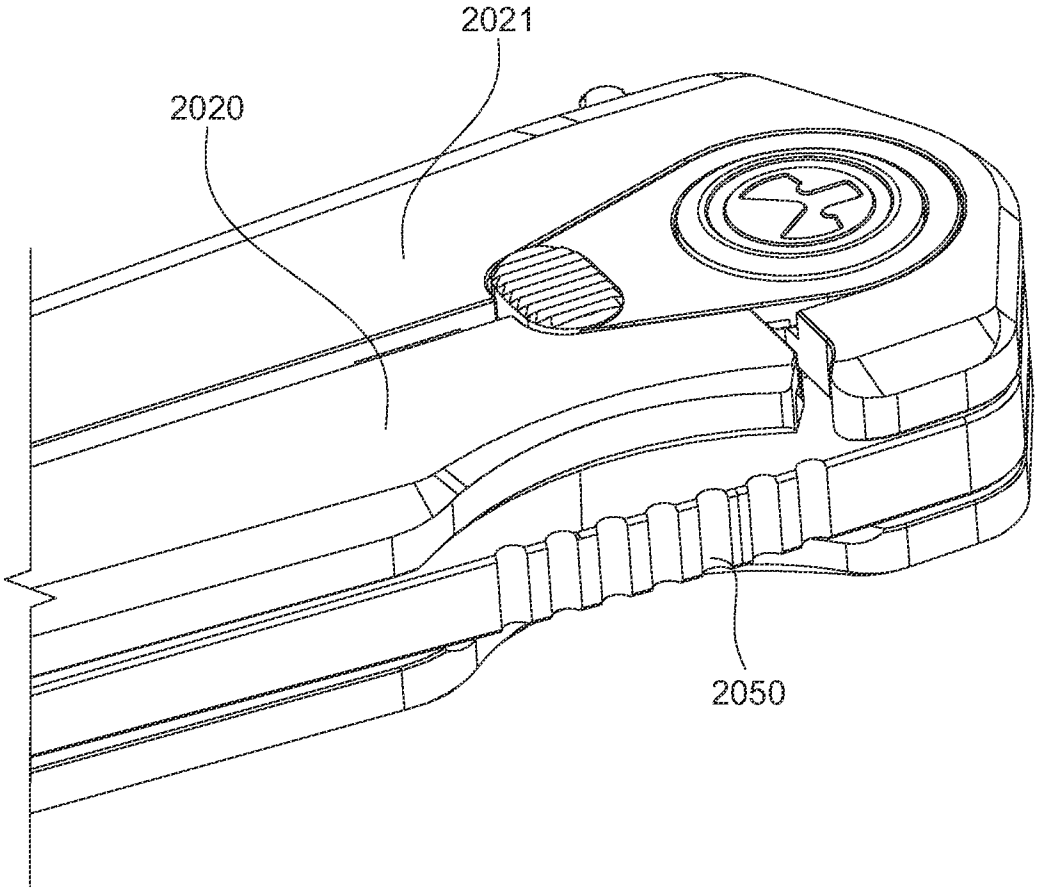
FIG. 20 shows a close-up view of the handle lock and the safety toggle switch of the folding knife of FIG. 1.

When a user wishes to extend and lock the knife, the user can use the blade flipper 158 shown in FIG. 18 to extend the blade 150. Alternatively, a user can grip the blade 150 through the handle lock cutout portion 122 shown in FIGS. 18 and 19. The blade ridges 155 (often referred to as jimping) can provide a surface for the user to push the blade 150 back into its folded position and can be used as a thumb placement for higher grip during finer cutting work. When the blade is in its folded position, the switch 180 is secured not only by the bias of its internal spring (not visible), but also by the shape formed by the handle lock 120 and the safety toggle switch cutout 182 themselves (see e.g., FIG. 20). Examples of the spring can be seen, for instance, in FIGS. 21-23.

Figure 21:
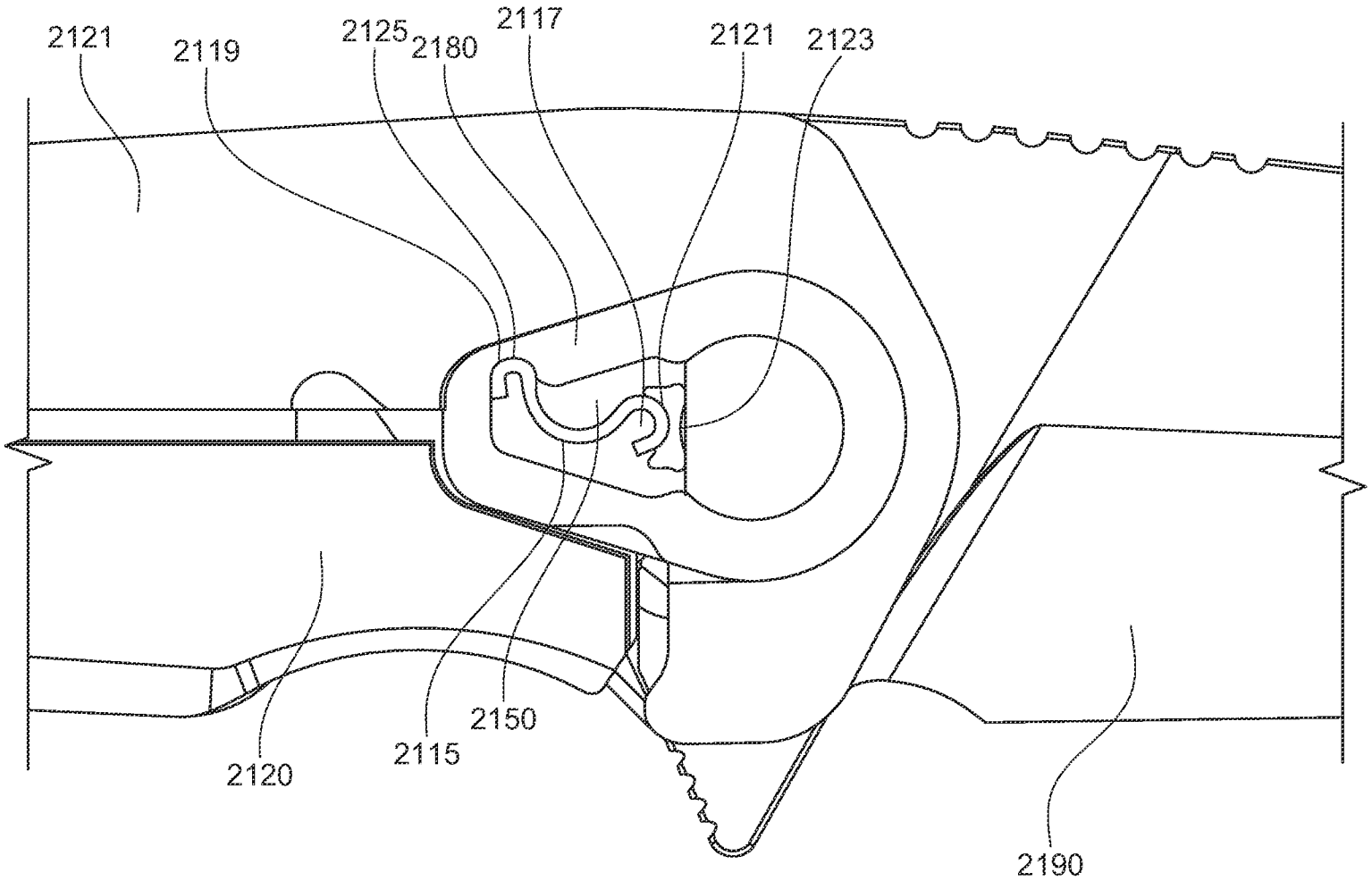
FIG. 21 shows a cross section of the folding knife showing an embodiment of a spring within the switch where the switch is in a disengaged position.
Figure 22:
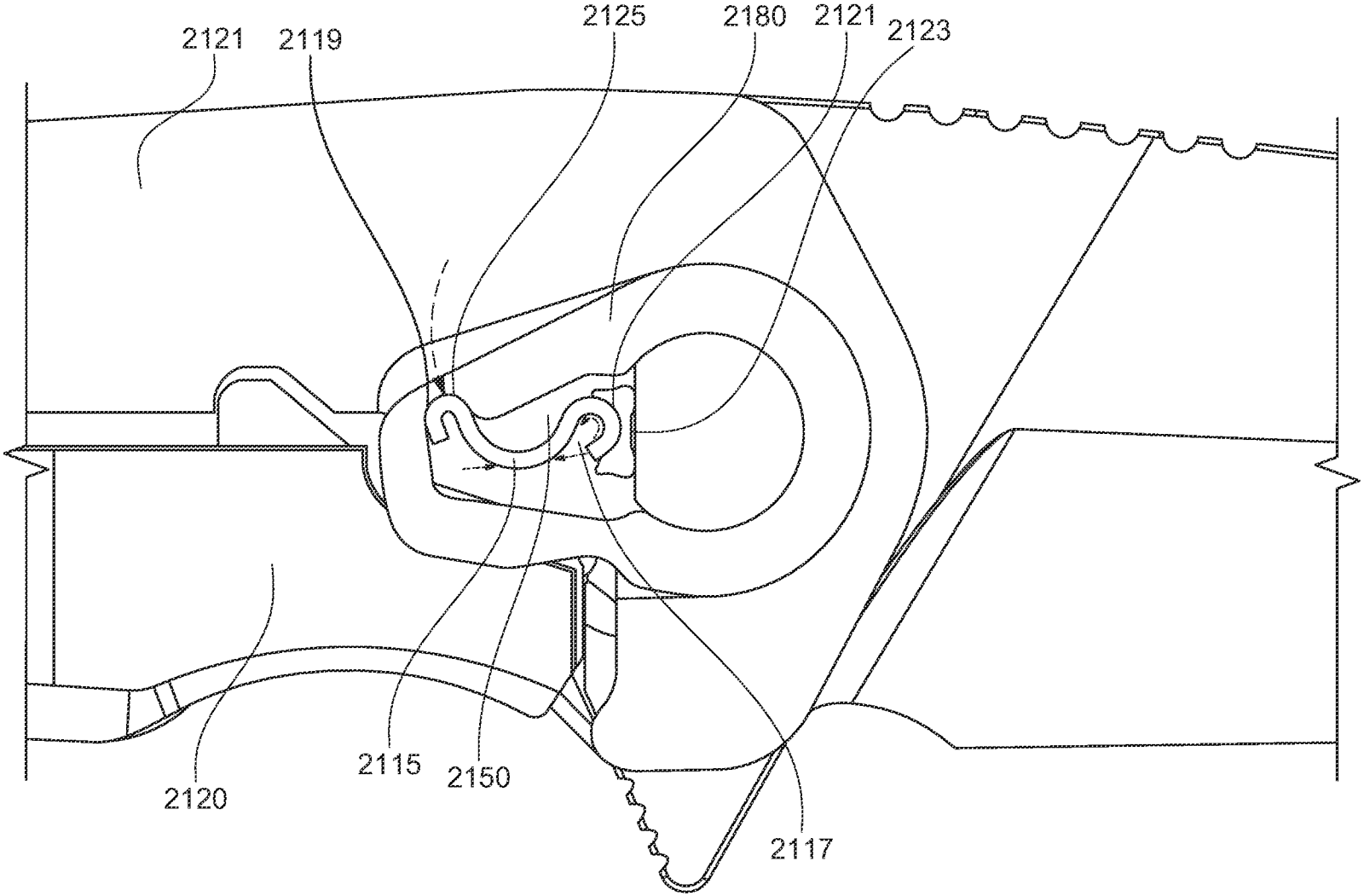
FIG. 22 shows a cross section of the folding knife showing the spring of FIG. 21 within the switch where the switch is in between an engaged and the disengaged position.
Figure 23:
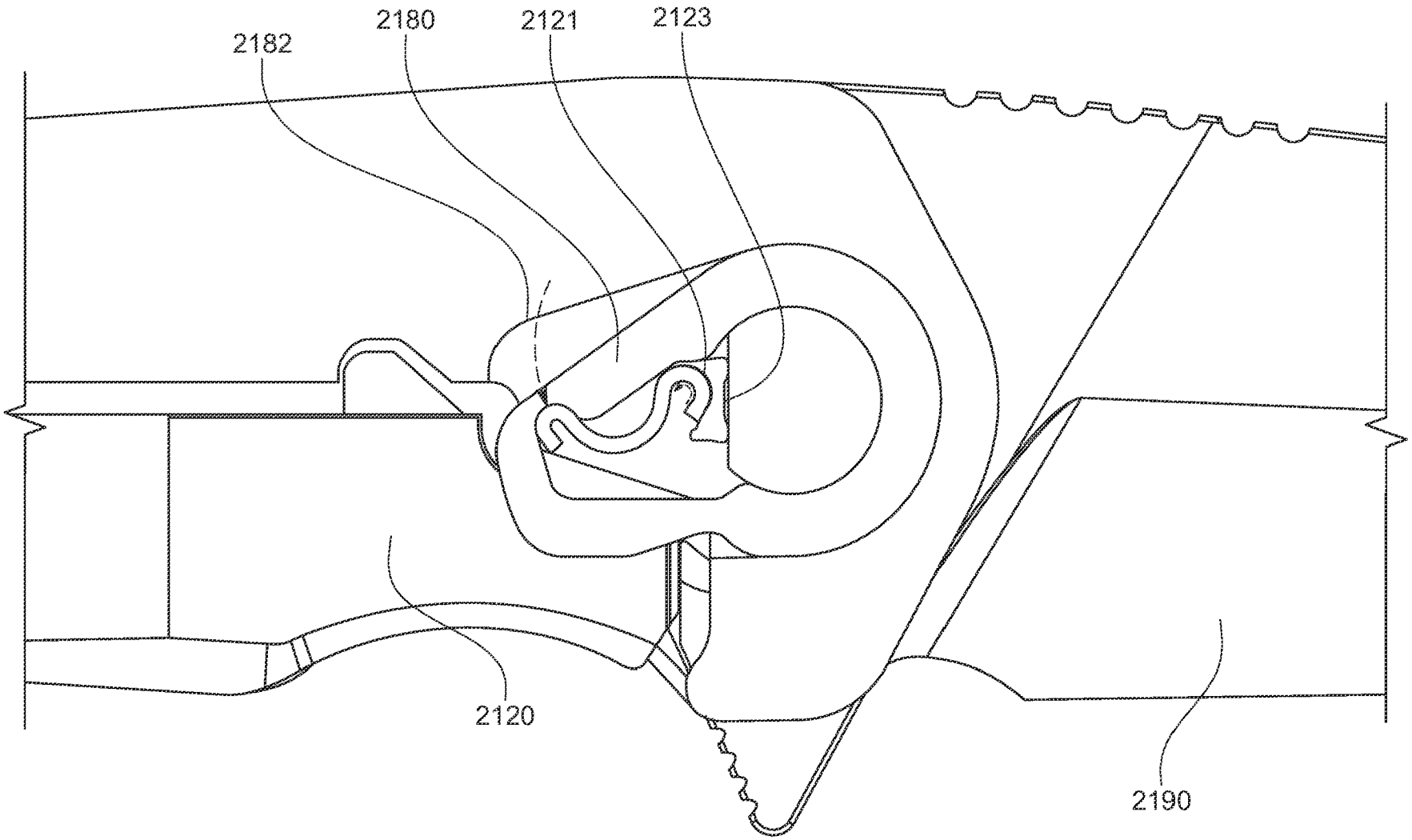
FIG. 23 shows a cross section of the folding knife showing the spring of FIG. 21 within the switch where the switch is in the engaged position.

The safety toggle switch can include a feature that causes the switch to securely rest in the engaged or disengaged position as previously described, which creates a tactile feel for the user that easily lets the user know when the switch is in its desired position. Such a feature can be a spring embedded in a pocket in the safety toggle switch, as shown in FIGS. 21-23. The spring can apply the rotational bias to the safety toggle switch that moves the switch toward an engaged or disengaged position when it is between those two positions and holds them in those positions once it reaches one of them. Though shown as a wire form spring, the spring can take various forms, such as a torsion spring, a leaf spring, a coil spring, belleville spring, etc.

FIGS. 21-23 illustrate an embodiment of a cross section of the switch, spring, and handle, to show how these components can interface to bias the switch in some embodiments. The cross section is taken through a middle of the switch 2180 such that a pocket 2150 is revealed that is otherwise not visible from a top or outside of the switch 2180. In the disengaged position (FIG. 21), the switch 2180 does not overlap the handle lock portion 2120 and thus allows the handle lock portion 2120 to be moved against its bias direction (out of the page in FIGS. 21-23) and thereby moved away from the tang of the blade 2190 such that the blade 2190 can be rotated toward a folded position (clockwise in FIGS. 21-23). In the engaged position (FIG. 23), the switch 2180 overlaps at least a portion of the handle lock portion 2120 and prevents the handle lock portion 2120 from being moved out of engagement with the tang of the blade 2190 (i.e., from moving out of the page).

The spring 2115 can be elongated and can be arranged within a pocket 2150 in the switch 2180. The pocket 2150 can be on an underside of the switch 2180 that is not exposed or visible to the user. The spring 2115 can have at least one curve therein, and in some instances a first end 2117 and a second end 2119 can also include curves, optionally curving in an opposing direction to a main curve of the spring 2115. In an embodiment, the spring 2115 can be an "Omega" shaped spring. FIGS. 21 and 23 show the spring 2115 in a more relaxed state, such that it presents a lesser bias on the switch 2180, but still sufficient bias to press the switch 2180 against sides of the switch cutout recess 2182. FIG. 22 shows the switch 2180 between the engaged and disengaged positions, such that the spring 2115 is further compressed than it is when the switch 2180 is in the engaged or disengaged positions. Accordingly, the spring 2115 also presents a greater rotational bias on the switch 2180. The direction and magnitude of the rotation bias depends on the position of the spring 2115 (see FIG. 25). In particular, at the maximum compression state, this apex of compression force represents an unstable equilibrium whereby any rotational shift will cause the switch 2180 to bias into either the engaged or disengaged position.

The spring 2115 can be a wire form spring. The first end 2117 can be proximal to a pivot axis of the switch 2180 and the second end 2119 can be distal from the pivot axis of the switch 2180. The first end 2117 can interface with a protrusion 2123 of the handle and rotate within a pocket 2121 of the protrusion 2123 as the switch 2180 rotates. The second end 2119 can nest in a sub-pocket 2125 in the protrusion 2123 of the switch 2180.

Figure 26:
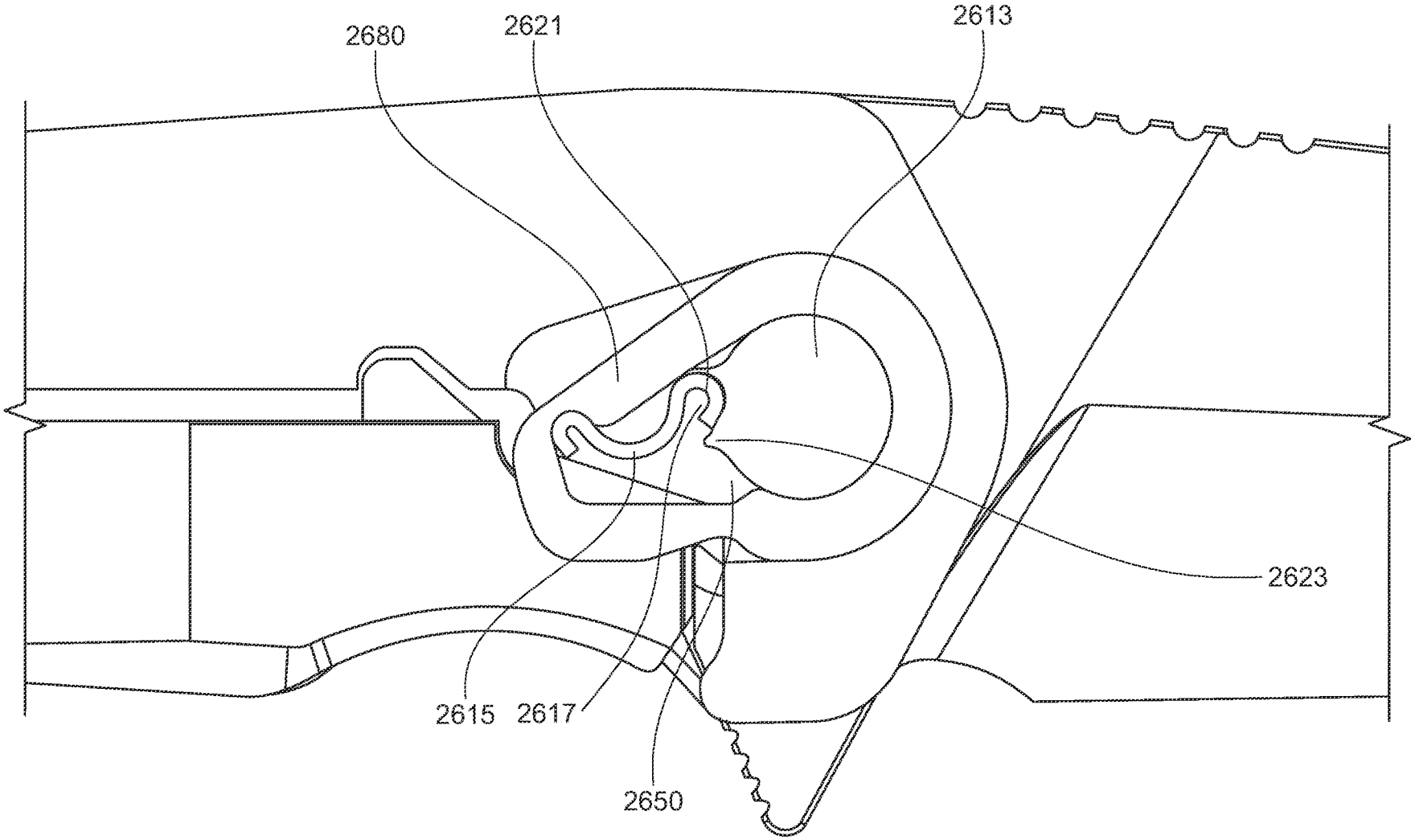
FIG. 26 shows one embodiment of a cross section of the folding knife showing the spring within the switch and a pocket of the pivot mechanism.

In an alternative embodiment, the pocket can be formed in a pivot mechanism around which the blade and the switch rotate. FIG. 26 illustrates such an embodiment. While the pivot mechanism 2613 is normally be a cylindrical structure without perturbations, in this embodiment a protrusion 2623 can extend outward from the pivot mechanism 2613 into the pocket 2650 of the switch 2680. The pocket 2621 of the pivot mechanism 2613 can be curved and/or concave and shaped to receive the first end 2617 of the spring 2615.

This example illustrates that any mechanism that allows increased compression of the spring when the switch is rotated, will be suitable for the purposes of this disclosure. Thus, the locations of the ends of the spring, what they are fixed to, and whether they are fixed or rotating, are variable.

Further, as long as the first end the spring can rotate within a fixed pocket, it does not matter whether the pocket is part of the handle, the pivot mechanism, or some other structure on the folding knife.

If the user applies a torque to the switch 2180, then this causes the switch 2180 to rotate, which in turn increases compression of the spring 2115 creating resistance to the user's attempt to rotate the switch 2180. However, after a certain amount of rotation of the switch 2180, and a maximum compression of the spring 2115, the spring 2115 begins to decompress and at this point it begins generating a torque or bias in the opposing direction—toward the engaged position of the switch 2180 (see plot of rotational bias as a function of switch position in FIG. 25). In the engaged position, at least a portion of the switch 2180 overlaps a portion of the handle lock 2120, thereby preventing the handle lock 2120 from moving out of engagement with the tang of the blade 2190.

Figure 24:
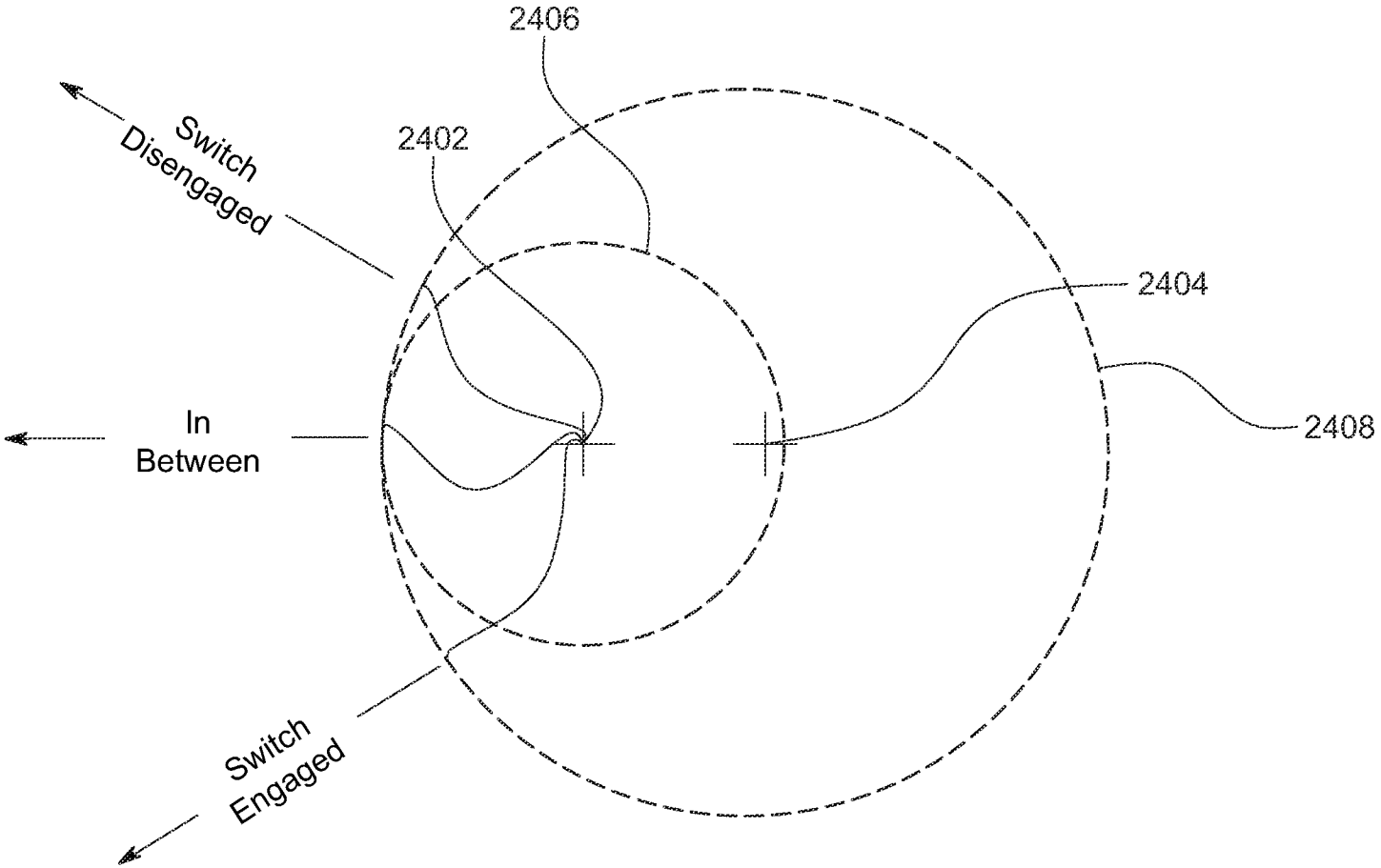
FIG. 24 shows an exaggerated illustration of the spring of any of the herein-described embodiments in three different positions along with curved paths traced by rotation of the switch and rotation of the second end of the spring.

FIG. 24 illustrates an exaggerated view of the spring 2115 in three different positions along with corresponding radii of curvature for the switch 2180 and the spring 2115. This exaggerated illustration helps show that when the switch 2180 is in the disengaged position, the spring 2115 is angled upward; in the engaged position, the spring 2115 is angled downward, and in between the disengaged and engaged positions, the spring 2115 is roughly oriented horizontally. Pivot axis 2402 is the pivot axis of the spring 2115, and pivot axis 2404 is the pivot axis of the switch 2180. The switch 2180 radius of curvature 2408 is wider than, and offset from, the radius of curvature 2406 for the spring 2115. As a result, the spring 2115 can be in a relaxed state when the switch 2180 is engaged or disengaged, and in a compressed state in between these two relaxed states since the radius of curvature 2408 of the switch 2180 moves toward the pivot axis 2402 of the spring 2115. One can also see that the spring 2115 is most compressed halfway between the switch's engaged and disengaged positions, and the torque or bias that it applies to the switch reverses on either side of this middle point and tapers off as the switch 2180 moves closer to the engaged or disengaged positions. These are relative positions shown for illustration only and do not necessarily correspond to a specific set of angles on the knife itself.

Figure 25:
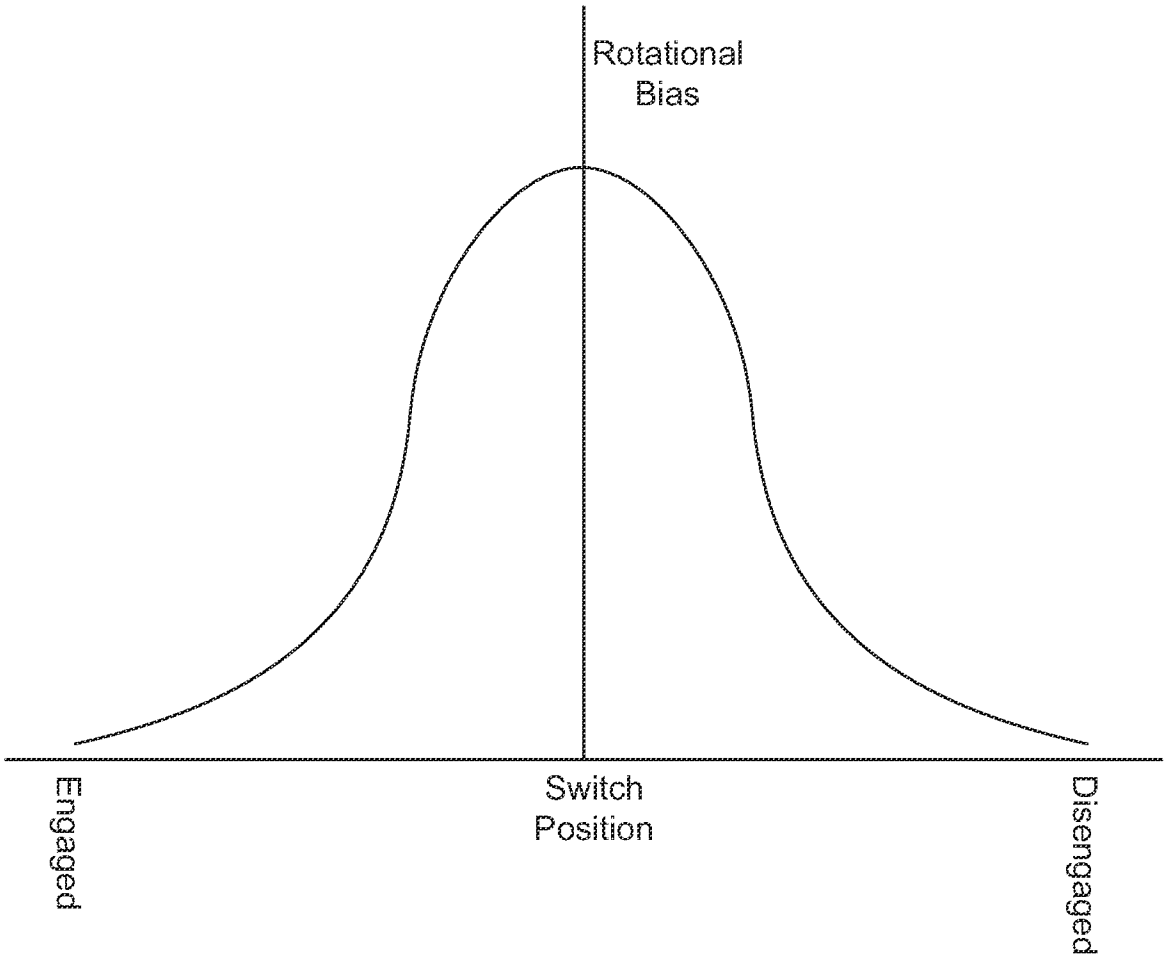
FIG. 25 shows one embodiment of a plot of rotational bias force/torque of the spring of any of the herein-described embodiments as a function of the switch's position.

FIG. 25 shows one embodiment of a plot of rotational bias force/torque of the spring as a function of the switch's position. At either extreme, the spring applies a small rotational bias on the switch pressing the switch against a side of the switch cutout recess. As the switch is rotated toward an opposing side of the switch cutout recess, a contrariwise rotational bias gradually increases until an apex is reached at a point bisecting the engaged and disengaged positions. Once the switch moves past this center position, the bias reverses and the spring begins to bias the switch toward the opposing position. One will appreciate that the bell-style force curve that is illustrated is just one force curve that could result from the various parameters of the spring and switch pivot axes, radii of curvature, etc.

Although this disclosure has generally referred to a handle lock that is part of a frame or handle of a locking folding knife, in some embodiments, the locking portion can be part of a liner that is coupled to a handle or frame. Such a locking mechanism can be referred to as a liner lock and would operate in a similar fashion to the handle lock described throughout this disclosure.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A locking folding knife comprising:

a handle;

a pivot axis;

a blade having a cutting edge and a tang, the blade is pivotably coupled to the handle such that the blade is pivotable relative to the handle about the pivot axis between a retracted position and an extended position, the cutting edge is exposed in the extended position and a portion of the blade is received within the handle in the retracted position;

a locking mechanism comprising a handle lock in the handle, and the handle lock being self-biased to a locked position contacting the tang of the blade when the blade is in the extended position for preventing the blade from closing when in the extended position; and a switch located in a switch cutout recess in the handle surrounding the pivot axis, the switch cutout recess being on an opposing side of the handle from the blade, and wherein the switch cutout recess surrounds the switch on at least three sides, wherein, when the blade is in the retracted position, the switch is not operable to pivot about the pivot axis and the switch is bounded on the at least three sides by the switch cutout recess and bounded on a fourth side by the handle lock, and wherein the switch is operable to pivot about the pivot axis between an engaged position and a disengaged position when the blade is in the extended position, wherein when the switch is pivoted to the engaged position, it blocks movement of the handle lock, and wherein when the switch is pivoted to the disengaged position, the handle lock is free to move into the unlocked position.

2. The locking folding knife of claim 1, further comprising a spring located in a pocket of the switch.

3. The locking folding knife of claim 2, wherein the spring is compressed in the engaged and disengaged positions, and compresses further when the switch is rotated between the engaged and disengaged positions.

4. The locking folding knife of claim 3, wherein compression of the spring generates a rotational bias on the switch.

5. The locking folding knife of claim 4, wherein the pocket of the switch includes a sub-pocket, and a first end of the spring rests within and rotates within a pocket of the handle and a second end of the spring rests within the sub-pocket of the switch.

6. The locking folding knife of claim 4, wherein a first end of the spring is rotationally coupled to a pivot mechanism.

7. The locking folding knife of claim 6, wherein the first end of the spring is rotationally coupled within a pocket of the pivot mechanism.

8. The locking folding knife of claim 2, wherein the pocket of the switch includes a sub-pocket, and a first end of the spring rests within and rotates within a pocket of the handle and a second end of the spring rests within the sub-pocket of the switch.

9. The locking folding knife of claim 2, wherein compression of the spring increases as the switch is rotated away from the engaged and disengaged positions until a midpoint in rotation is reached.

10. The locking folding knife of claim 1, further comprising a spring located in the switch that generates a rotational bias on the switch, and wherein the spring provides bias to press the switch against one or more sides of the switch cutout recess in either of the engaged and disengaged positions.

11. A locking folding knife comprising:

a frame having first and second sides, the first side being split into a fixed portion and a handle lock that flexes between a locked position and an unlocked position and the handle lock is self-biased to the locked position; and a rotatable switch mounted to the frame and rotatable around a pivot axis of the lockable folding knife, wherein the rotatable switch is located in a switch cutout recess in the frame surrounding the pivot axis, the switch cutout recess being on the first side of the frame and fully surrounding the rotatable switch along a perimeter of a widest portion of the rotatable switch when the rotatable switch is in either an engaged position or a disengaged position, wherein in the engaged position the rotatable switch is at least partially arranged over the handle lock thereby preventing the handle lock from moving to the unlocked position, and wherein in the disengaged position the rotatable switch is not arranged over any portions of the handle lock thereby allowing the handle lock to be moved between the locked position and unlocked positions.

12. The locking folding knife of claim 11, further comprising a spring located in a pocket of the rotatable switch for generating a rotational bias on the rotatable switch, and wherein the spring provides bias to press the rotatable switch against one or more sides of the switch cutout recess.

13. The locking folding knife of claim 12, wherein the spring is compressed in the engaged and disengaged positions, and compresses further when the rotatable switch is between the engaged and disengaged positions and this increased compression generates a corresponding increased rotational bias on the spring.

14. A method of manufacturing a lockable folding knife, the method comprising:

forming a blade;

forming a frame having a first side and a second side;

forming a slit in the first side to split the first side into a non-movable portion and a flexible portion movable between locked and unlocked positions, and the handle lock self-biased toward the locked position;

rotatably affixing the blade to the frame at a pivot axis of the blade;

forming a rotatable switch;

mounting the rotatable switch in a rotating manner at the pivot axis, wherein the rotatable switch is located in a switch cutout recess on the first side of the frame, the rotatable switch having an engaged and a disengaged position when the blade is in an extended position, wherein in the engaged position the rotatable switch is arranged over at least a portion of the flexible portion thereby preventing the flexible portion from moving to the unlocked position, and wherein in the disengaged position and with the blade in a retracted position, the rotatable switch is bounded on three sides by the switch cutout recess and bounded on a fourth side by the flexible portion of the frame.

15. The method of claim 14, further comprising forming a spring and mounting the spring within a pocket of the rotatable switch.

16. The method of claim 15, wherein compression of the spring increases as the rotatable switch is rotated away from the engaged and disengaged positions until a midpoint in rotation is reached.

17. The method of claim 16, wherein the pocket of the switch includes a sub-pocket and the method further comprising arranging a first end of the spring within a pocket of the handle and arranging a second end of the spring within the sub-pocket of the rotatable switch.

18. The method of claim 15, wherein the pocket of the switch includes a sub-pocket and the method further comprising arranging a first end of the spring within a pocket of the handle and arranging a second end of the spring within a sub-pocket of the rotatable switch.

19. The method of claim 15, wherein compression of the spring increases as the rotatable switch is rotated away from the engaged and disengaged positions until a midpoint in rotation is reached.

20. The method of claim 14, further comprising forming a spring and mounting the spring within the rotatable switch, wherein the spring generates a rotational bias on the rotatable switch, and wherein the spring provides bias to press the rotatable switch against one or more sides of the switch cutout recess.

* * * * *